US005701727A

United States Patent [19]

Lundstrom et al.

[11] Patent Number: 5,701,727

[45] Date of Patent: Dec. 30, 1997

[54] CARD AFFIXING AND FORM FOLDING SYSTEM

[75] Inventors: Robert W. Lundstrom, Plymouth; Roger D. McCumber, Minnetonka; Benjamin H. Sannel, Minneapolis, all of Minn.

[73] Assignee: Datacard Corporation, Minneapolis, Minn.

[21] Appl. No.: 372,298

[22] Filed: Jan. 13, 1995

[51] Int. Cl.[6] ..... B41F 13/54; B65H 39/02; B65B 61/00

[52] U.S. Cl. ..... 53/569; 53/117; 53/284.3; 493/144; 493/417; 493/436; 493/442; 493/451; 156/441.5; 156/574; 156/580

[58] Field of Search ..... 156/441.5, 442, 156/438, 556, 572, 574, 580, 582; 493/10, 13, 14, 15, 16, 17, 19, 23, 25, 27, 28, 29, 320, 321, 331, 334, 374, 379, 393, 417, 436, 442, 451, 454, 458, 459, 472, 144, 141, 142, 216; 53/117, 120, 569, 206, 284.3, 460, 157, 116, 238, 155, 131.4, 411

[56] References Cited

U.S. PATENT DOCUMENTS

| | | | |
|---|---|---|---|
| 3,278,178 | 10/1966 | Eckl | 270/61 |
| 3,394,389 | 7/1968 | Amir | 269/84 |
| 3,572,682 | 3/1971 | Leach et al. | 270/52 |
| 4,034,210 | 7/1977 | Hill et al. | 53/284.3 X |
| 4,055,932 | 11/1977 | Wanner | 53/63 |
| 4,085,928 | 4/1978 | Sussman | 270/61 |
| 4,091,268 | 5/1978 | Jarleton et al. | 53/284.3 X |
| 4,326,704 | 4/1982 | Barr | 270/58 |
| 4,351,517 | 9/1982 | Neal et al. | 270/52 |
| 4,586,703 | 5/1986 | McAnelly | 270/39 |
| 4,641,575 | 2/1987 | Cavagna | 101/23 |
| 4,746,109 | 5/1988 | Bar et al. | 270/95 |
| 4,832,327 | 5/1989 | Johansson | 271/9 |
| 4,844,439 | 7/1989 | Johansson | 271/192 |
| 4,851,075 | 7/1989 | Parker | 156/556 |
| 4,988,223 | 1/1991 | Hilkenmeier et al. | 400/124 |
| 5,012,073 | 4/1991 | Hewitt et al. | 235/375 |
| 5,045,148 | 9/1991 | Hoffstetter et al. | 156/567 |
| 5,058,873 | 10/1991 | Hewitt et al. | 270/52 |
| 5,082,268 | 1/1992 | Santoro | 271/14 |
| 5,388,815 | 2/1995 | Hill et al. | 53/157 X |
| 5,445,367 | 8/1995 | Long | 53/284.3 X |
| 5,451,037 | 9/1995 | Lundstrom | 270/1.1 |

OTHER PUBLICATIONS

Document A –Logika Comp Brochure for Card Mailer, 4 pp. This brochure was in existence at the time the present application was filed. Therefore, the Examiner is respectfully requested to consider the device disclosed therein as prior art.

Document B –Logika Comp Brochure for Card Mailer System, 4 pp. This brochure was discovered recently and the publication date is presently unknown.

Document C –Bowe Systec Brochure for the Bowe 657 Plastic Card System, 2 pp. The publication date for this brochure was Mar. 1993.

Document D –Bowe Systec Brochure for the Bowe 657 Plastic Card System, 4 pp. The publication date for this brochure was Mar. 1994.

(List continued on next page.)

*Primary Examiner*—James F. Coan

*Attorney, Agent, or Firm*—Merchant, Gould, Smith, Edell Welter & Schmidt

[57] ABSTRACT

A system for affixing cards to a form and folding the form with the cards attached. The system includes a card affixer for affixing cards to any location on a form having a form transporting mechanism for moving the form, a carriage for receiving and holding a card, a carriage translating mechanism for moving the carriage across the width of the form transporting mechanism and a pressing mechanism for pressing the card against the form. The system also includes a form folder for precisely folding forms with the cards already attached. The form folder includes a form guide structure having at least one scoring edge, a form transfer mechanism, a roller unit, a roller translating mechanism and a roller rotating mechanism.

18 Claims, 19 Drawing Sheets

OTHER PUBLICATIONS

Document E –Bowe Systec Brochure for the Plastic Card System Bowe 657 On Line on the Non–Impact Printer, 2 pp. The publication date for this particular brochure was Feb. 1995.

Document F –Bowe Systec Brochure for the Bowe 650 Plastic Card System, 4 pp. This brochure was in existence at the time the present application was filed. Therefore, the Examiner is respectfully requested to consider the device disclosed therein as prior art.

Document G –CIM Brochure for CIMailer, 2 pp. This brochure was discovered recently and the publication date is presently unknown.

Document H –Protechno Card Brochure for PTO 7000 Systems, 4 pp. This brochure was in existence at the time the present application was filed. Therefore, the Examiner is respectfully requested to consider the device disclosed therein as prior art.

PRINTER MODULE
20
22
158
STICKER MODULE
34
30
CARD AFFIXING MODULE
38
SENSOR
34
22
34
22
34
HOLDING TRAY
42
10
FORM FOLDING MODULE
40
22
SYSTEM CONTROLLER
36
39
STORAGE DEVICE
KEYBOARD
37
FORM OUTPUT STACKER
51
ENVELOP STUFFING MODULE
50

CARD AFFIXING AND FORM FOLDING SYSTEM

FIELD OF THE INVENTION

The present invention relates to a device which affixes cards upon a pro-printed form and folds the form with the cards remaining affixed.

BACKGROUND OF THE INVENTION

With the rapid expansion of the credit card industry and the widespread use of personalized cards as a source of identification, there has been a need to increase the efficiency in which personalized cards are mailed to customers. Originally, personalized cards were manually attached to their respective personalized form letter and were manually folded and placed in an envelope to be mailed to the customer. This manual process rapidly gave way to automated card affixing and form folding mechanisms which greatly increased the efficiency of the mailing process.

Conventional automated card affixing and form folding systems use buckle folding technology. In the conventional buckle folding system, the forms are first printed with the necessary customer information. Second, the forms are fed into a conventional buckle folder for folding. In operation, a conventional buckle folder uses rollers to feed the pre-printed form against a stopping plate. As the form is fed against the stopping plate, the form is caused to buckle. A pair of rotating fold rollers are positioned adjacent to the stopping plate such that when the form begins to buckle, the buckled form is fed into the pair of rotating fold rollers thereby creating a fold at the buckled portion of the form.

For conventional buckle folders to work properly, they must feed the form though very narrow pathway clearances and around tight curves. The narrow pathways and tight curves are incompatible with folding forms having cards already attached. Therefore, to use a conventional folder in the card mailing industry, the form must be folded before the cards are attached. To attach cards to the pre-folded form, the form must be unfolded to expose the interior flaps.

Because the conventional buckle folder uses a two step process of folding and unfolding the form, it requires extra equipment and is therefore more expensive than a folder that can fold a form having cards already attached. Additionally, in the case of C-folds or Z-folds, the personalized cards can only be affixed to the two panels of the form which have been opened. No cards can be affixed to the bottom panel. In contrast, cards affixed to the form before it is folded can be affixed at any location on the form. In this way, a folder that folds a form having cards already attached provides greater card placement flexibility to enhance the presentation of the card to the customer.

Another problem with the conventional buckle folder is that it cannot create different types of folds such as V-folds, C-folds or Z-folds without mechanical alteration. This inflexibility is not consistent with the needs of a customer who wants a machine that can easily produce a variety of folds.

A second type of folder used in the card mailing industry is a modified buckle folder. As compared to the conventional buckle folder, the modified buckle folder has more open passageways and more gradual curves. Therefore, the modified buckle folder can fold forms having cards already attached. However, for the modified buckle folder to work properly, the forms must be made of heavy paper having perforations where the form is to be folded. Heavy perforated paper is expensive and aesthetically less attractive than standard form paper.

A third type of folder used in the card mailing industry is a plow folder. Plow folders use long curved form guides to gradually fold a form as the form is fed widthwise along the guide. The fold is completed by feeding the form through a set of rollers. Plow folders can fold a form having cards attached. However, plow folders have difficulty controlling the accuracy of the fold. Additionally, plow folders consume a great deal of space and require 90 degree turn mechanisms to make the folders compatible with the lengthwise form transport direction of conventional printing, card affixing and envelop stuffing mechanisms. Finally, the plow folder can not make extremely tight folds without de-embossing the affixed cards or leaving an imprint on the form.

In regards to affixing a card to a form, the card mailing industry utilizes a variety of affixing systems. For example, some systems simply use glue. Other systems use pre-cut slits in the form or double sided tape to affix a card to the form. More recent developments in the card affixing industry have focused upon card affixing systems that use an adhesive strip having a heat sensitive adhesive side and a pressure sensitive adhesive side.

In operation, the heat sensitive adhesive side of the sticker is first attached to the back of the personalized card. Second, the personalized card is moved onto its respective form. Third, a press mechanism having a pad exerts area pressure on the front side of the personalized card thereby causing the pressure sensitive adhesive attached to the back of the card to bond with the surface of the form thereby affixing the personalized card to the form. The bond between the heat sensitive adhesive and the back of the personalized card is weaker than the bond between the pressure sensitive adhesive and the form surface. If the pressure sensitive adhesive is properly bonded to the surface of the form, the difference in bond strength allows the personalized card to be pulled from the form without leaving any adhesive residue on the back of the card.

Existing card affixing mechanisms which utilize adhesive as a means of affixing cards to forms have several problems. First, existing card affixing mechanisms lack flexibility in being able to place the personalized cards at any location on the form. Second, existing card affixing mechanisms use powerful stamping mechanisms to exert area pressure on the face of the card, thereby bonding the pressure sensitive adhesive to the surface of the form. Due to the intense pressure exerted by the stamping mechanism, the personalized card can be de-embossed or an imprint can be left on the form. Additionally, large stamping mechanisms are expensive to manufacture and operate. Third, the area pressure exerted by the stamping mechanism is often uneven across the surface of the card. This disproportionate pressure causes some of the pressure sensitive adhesive to bond to the surface of the form while leaving other pressure sensitive adhesive unbonded. Because all of the pressure sensitive adhesive is not bonded to the surface of the form, when the card is pulled from the form by the customer, paper and adhesive residue is often left on the back of the card. Fourth, the adhesive strip needs to be placed precisely under the stamping pad in order to effectively affix the card to the form.

SUMMARY OF THE INVENTION

The combined card affixing and form folding system of this invention has a card affixing module that receives printed forms directly from a printer module as is commonly known in the art. The card affixing module also receives personalized cards from a sticker module which has attached a card affixing sticker on the card. Once the card affixing module receives the printed form and the personalized card, the card affixing module affixes the appropriate personalized cards to their corresponding forms and then transfers the forms to a folding module. The form folding module receives the forms which are carrying the affixed cards and folds the forms with the cards remaining attached. Once the appropriate fold is made in the form, the folded form is transferred to a form output stacker or an envelope stuffing module which places the folded form in an envelope and prepares the envelope for mailing.

The card affixing module of this invention includes a card carriage positioned proximate to a form transporting mechanism. The form transporting mechanism has a width and length and transports the form along its length. The card carriage receives the personalized cards having the affixing stickers attached from the sticker module and holds them. The card carriage is connected to a card carriage translating mechanism which moves the carriage across the width of the form transporting mechanism. The carriage is also connected to a card pressing mechanism which presses the card against the form to cause the card to become affixed to the form.

In an embodiment of the card affixing module, the form transporting mechanism has a plurality of roller units aligned progressively along it's length. The carriage translating mechanism of this embodiment includes a lead screw which is positioned to extend across the width of the form transporting mechanism. The carriage is connected to a lead screw nut which is threadingly mounted on the lead screw. When the lead screw is rotated within the lead screw nut, the lead screw nut and the connected carriage are caused to translate axially along the lead screw.

Additionally, the pressing mechanism of this embodiment includes at least one pressing roller that is connected to an actuating source that presses the roller against the card. The pressing roller mechanism exerts a rolling line force across the surface of the card thereby pressing the card against the form and causing the card to become affixed to the form. Moreover, the card affixing module of this embodiment has a card sensing device which senses when cards have been improperly affixed to the form and shuts down the card affixing apparatus. Furthermore, the card affixing module of this embodiment has a form diversion mechanism which diverts forms from the card affixing apparatus to a form holding tray.

The form folding module of this invention has a form guide structure which has at least one form scoring edge. A form transfer mechanism feeds forms across the form guide structure so that a portion of each form extends past the form scoring edge. A first roller unit having a first roller aligned adjacent to a second roller is positioned adjacent to the form scoring edge. The first and second rollers define a folding nip located between the first and second rollers. A roller translating mechanism is connected to the first roller unit. The roller translating mechanism translates the first roller unit towards the scoring edge thereby causing the first roller to come in rolling contact with the portion of the form which extends past the scoring edge. The form is pinched between the first roller and the scoring edge thereby creating a scored line on the form. The roller translating mechanism stops the translation of the first roller unit when the folding nip is adjacent to the scored edge. The form folding module also has a roller rotating mechanism which rotates the first and second rollers when the folding nip is adjacent to the scoring edge. The scored form is then fed into the folding nip of the rotating first and second rollers by the form transfer mechanism. As the scored form is fed into the folding nip, the form is pressed between the rotating first and second rollers thereby creating a fold at the scored line.

In an embodiment of the form folding module, the form guide structure has a first pinching unit having a first hinged nipping member which opposes and cooperates with a second hinged nipping member. In another embodiment of the form folding module, a plurality of pinching units are aligned in series between a plurality of roller units thereby allowing multiple folds to be made on a single form without reversing the direction of the form within the form transfer mechanism. In yet another embodiment of the form folding module, the form guide structure has a pair of symmetrical pinching units. In still another embodiment of the form folding module, the form folding module has a first crease roller aligned adjacent to a second crease roller. Located between the first crease roller and the second crease roller is a creasing nip. A pressing mechanism is connected to the first crease roller. When a fold is detected within the creasing nip, the pressing mechanism presses the first crease roller towards the second crease roller thereby pinching the fold between the rollers and tightly creasing the fold.

The design of the combined card affixing and form folding system has many advantages over the prior art. A first set of advantages of the combined card affixing and form folding system relate to the design of the form folding module. Unlike the prior art, the form folding module of this invention can precisely fold a form having cards previously affixed without using a perforated heavy papered form. Also, the form folding module of this invention is computer controlled and can create various types of folds in a form without being mechanically altered. Moreover, the form folding module of this invention consumes little space and transports the form in a direction compatible with the form transport direction of conventional printers, card affixers and envelop stuffers. Furthermore, in contrast to the prior art, the form folding module of this invention can vary the tightness of the folds without leaving an imprint on the form or de-embossing the cards that are affixed to the form.

Additional advantages of the combined card affixing and form folding system relate to the design of the card affixing module. For example, unlike the prior art, the card affixing module of this invention is computer software controlled and can affix the card to any location on a form without mechanically altering structure of the card affixing module. Also, an embodiment of the card affixing module of this invention utilizes a roller pressing mechanism which affixes personalized cards to forms by exerting a rolling line force across the surface of the card rather than an area force. Because the press rollers exert a rolling line force rather than an area force, they are able to adequately affix the card to the form without requiring the excessive force required by traditional area pressure stamping mechanisms. Because the rolling press mechanism exerts less force than existing stamping mechanisms, it requires smaller, lighter press mechanisms which are less expensive to manufacture and operate than larger press mechanisms. Additionally, because the press roller mechanism rolls completely over the surface of the card, the pressure sensitive adhesive can be located anywhere on the card rather than precisely under a given pressing pad.

A further advantage of the card affixing module of this invention relates to the fact that the press roller mechanism is gimballed so as to exert an equal pressure across the surface of the card. The gimballing of the press roller mechanism serves two main purposes. First, because the pressure from the press roller is distributed across the surface of the card, there is a greater likelihood that all of the pressure sensitive adhesive on the back of the card will be caused to bond to the form surface. Second, because the pressure is distributed equally across the surface of the card, the card is much less likely to become skewed as it is affixed to the form.

These and other advantages and features of novelty which characterize the invention are pointed out with particularity in the claims which form a part of this application. However, for a better understanding of the invention, its advantages and objects obtained by its use, reference should be had to the drawings and written specifications of this application in which there is illustrated and described preferred embodiments of the invention.

BRIEF DESCRIPTION OF THE DRAWINGS

Referring now to the drawings wherein referenced numerals generally indicate corresponding parts throughout the several views.

DETAILED DESCRIPTION OF THE PREFERRED EMBODIMENT

Throughout the following description, reference will be made to the drawings and the same numerals will be used throughout the several views to indicate the same or like parts of the invention.

Figure 1:
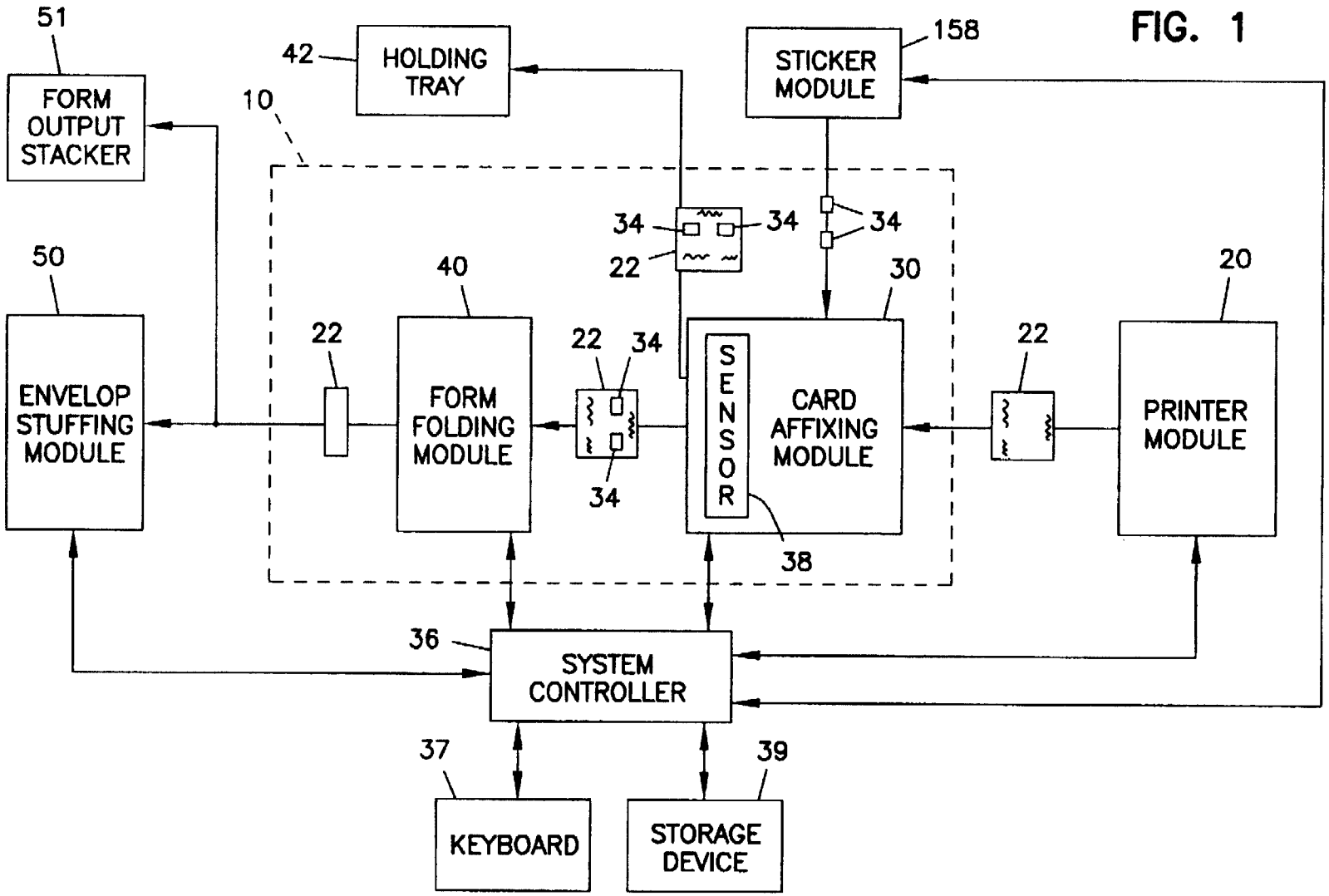
FIG. 1 is a schematic diagram of an embodiment of the card affixing and form folding system of this invention.

Referring now to FIG. 1, there is illustrated an embodiment of a combined card affixing and form folding system 10 in accordance with the principles of this invention. As shown in the diagram, a printer module 20 is connected to the combined card affixing and form folding system 10. The printer module 20 supplies a printed form 22 to a card affixing module 30 within the combined card affixing and form folding system 10. The card affixing module 30 is connected to a sticker module 158 which supplies cards 34 to the card affixing module 30. The cards 34 have a personalized front side 29 and a back side 31 having an adhesive strip 160 and often having a coded magnetic strip. The card affixing module 30 can affix multiple cards 34 at any location on the form 22 without needing any mechanical alteration.

The card affixing module 30 is also equipped with a card verification sensor 38 which senses if the cards 34 have been properly affixed to the form 22. If the card verification sensor 38 detects an improperly affixed card 34, the card affixing module 30 is immediately shutdown, thereby allowing an operator (not shown) to remove the defective card 34 and form 22.

Once the form 22 and affixed cards 34 clear the card verification sensor 38, they are usually transferred to a folding module 40 that is part of the combined card affixing and form folding system 10. However, if an operator (not shown) does not wish the form 22 with the affixed cards 34 to be folded, the printed form 22 with the affixed cards 34 can be diverted into a form holding tray 42 which collects the unfolded forms 22 with the affixed cards 34.

If the form 22 with the affixed cards 34 clears the card verification sensor 38 and is not diverted to the form holding tray 42, it is transferred directly to the folding module 40 that folds the form 22 with the cards 34 remaining affixed to the form 22. The folding module 40 can implement a wide variety of folds at a variety of locations without having to undergo any mechanical alterations. For example, the folding module 40 can create a V-fold, a Z-fold or a C-fold without manually altering any physical feature of the folder 40. The folding module 40 also has the capability of making folds having variable tightness without imprinting the form 22 or de-embossing the affixed cards 34.

Once the form 22 is properly folded by the folding module 40, it is transferred from the combined affixing and form folding system 10 to a form output stacker 51 or an envelope stuffing module 50 as is commonly known in the art which places the folded form 22 in an envelope and prepares the envelope for mailing.

The combined card affixing and form folding system 10 is controlled by a system controller 36 that processes data such as the names and addresses of customers, bulk mailing lists, the type and location of the folds to be completed on a particular form, the number and location cards which are to be affixed to a particular form, etc. The system controller 36 includes a suitable processor with associated memory and may include storage devices 39 such as floppy and hard disk drives for storage of programs and/or card data. In one embodiment of the system controller 36, an INTEL 486SX processor is used , although other suitable processors may be used. The central controller 36 also includes a CRT display (not shown) for display of system information, a keyboard 33 or a pointing device (not shown) such as a mouse, trackball, touch screen, pen light, etc., for operator input. In regard to system control of the combined card affixing and form folding system 10, reference may be made to U.S. Pat. No. 5,266,781 to Warwick et al., hereby incorporated by reference, which discloses a modular card processing system.

The printer module 20, card affixing module 30, sticker module 158, folding module 40 and envelope stuffing module 50 each has a separate local module processor (not shown) mounted on a module control circuit board (not shown) for converting data and configuration commands from the system controller 36 into specific motor and motion control instructions for controlling the local processing functions at each of the modules 20, 30, 40, 50, 158. It will be appreciated that any number of different processors commonly known in the art might be used.

The schematic diagram of FIG. 1 provides a general flow chart relating to the operation of the preferred embodiment of the combined card affixing and form folding system 10. As described above, the operation of the combined card affixing and form folding system 10 is coordinated and controlled local module processors (not shown) that receive and implement data and configuration commands from the system processor 36. The remainder of this specification will focus on disclosing in detail the specific individual mechanical components which interrelate to form the combined card affixing and form folding system 10 which is outlined in FIG. 1.

Figure 2:
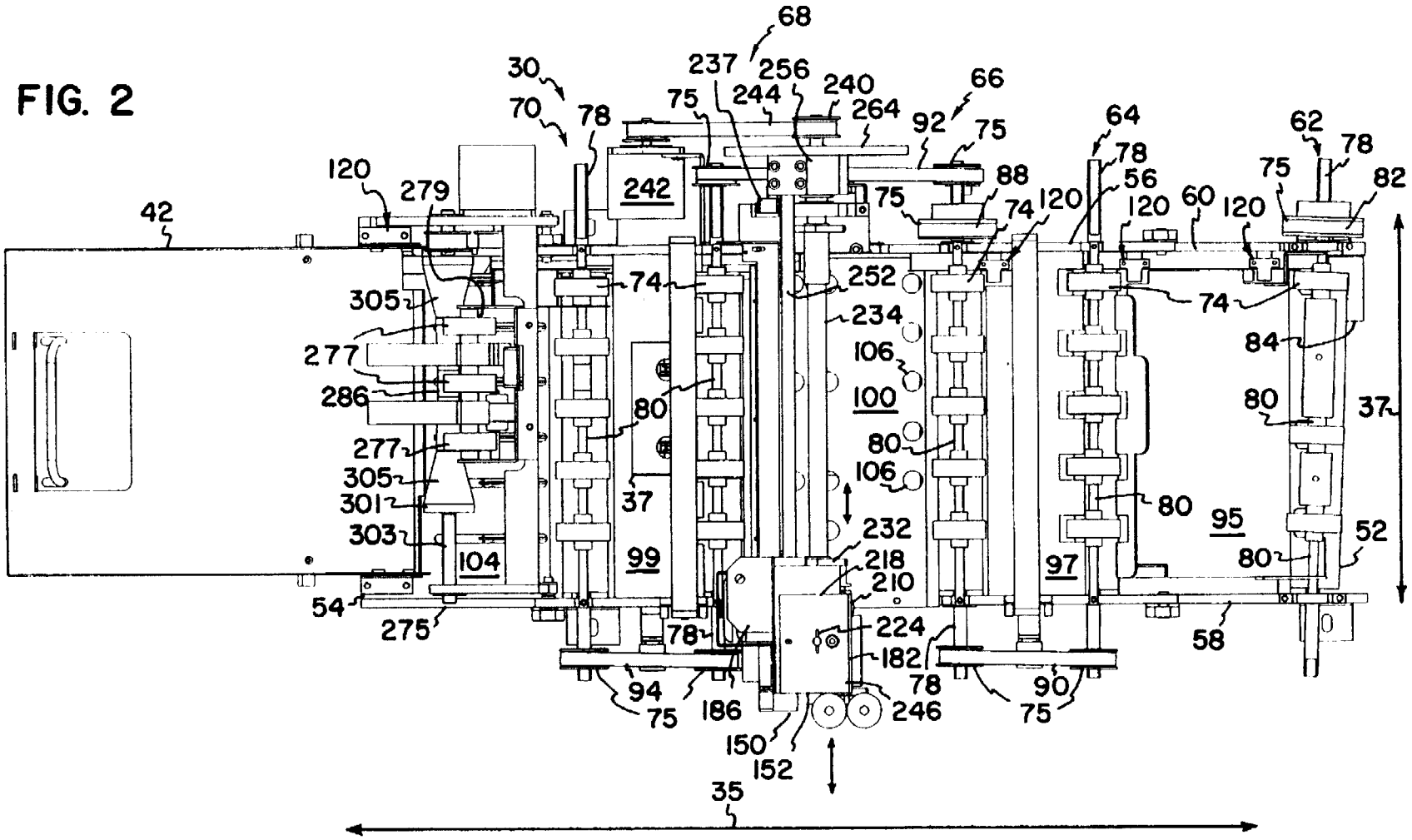
FIG. 2 is a top plan view of an embodiment of the card affixing module of this invention.

Referring now to FIG. 2, there is illustrated a top view of the preferred embodiment of the card affixing module 30 in accordance with the principles of this invention. The card affixing module 30 has a length 35 and a width 37. The card affixing module 30 also has an upstream end 52 which is located adjacent to the printer module 20 and a downstream end 54 which is located adjacent to the folding module 40. The card affixing module 30 also has a generally vertical first side plate 56 located opposite from a generally parallel second side plate 58. The first side plate 56 and the second side plate 58 extend from the upstream end 52 to the downstream end 54 of the card affixing module 30. Continuous along the entire length of the first side plate 56 is an upper lip 60 which functions as a form edge guide.

The card affixing module 30 has five roller units 62, 64, 66, 68, 70 which cooperate to transfer the form 22 from the upstream end 52 to the downstream end 54 of the affixing module 30. This is accomplished by aligning the roller units 62, 64, 66, 68, 70 progressively downstream. For example, the first roller unit 62 is located adjacent to the upstream end 52 of the card affixing module 30. The second roller unit 64 is positioned horizontally downstream from the first roller unit 62. The third roller unit 66 is positioned horizontally downstream from the second roller unit 64. The fourth roller unit 68 is positioned horizontally downstream from the third roller unit 66. Finally, the fifth roller unit 70 is positioned horizontally downstream from the fourth roller unit 68.

Figure 3:
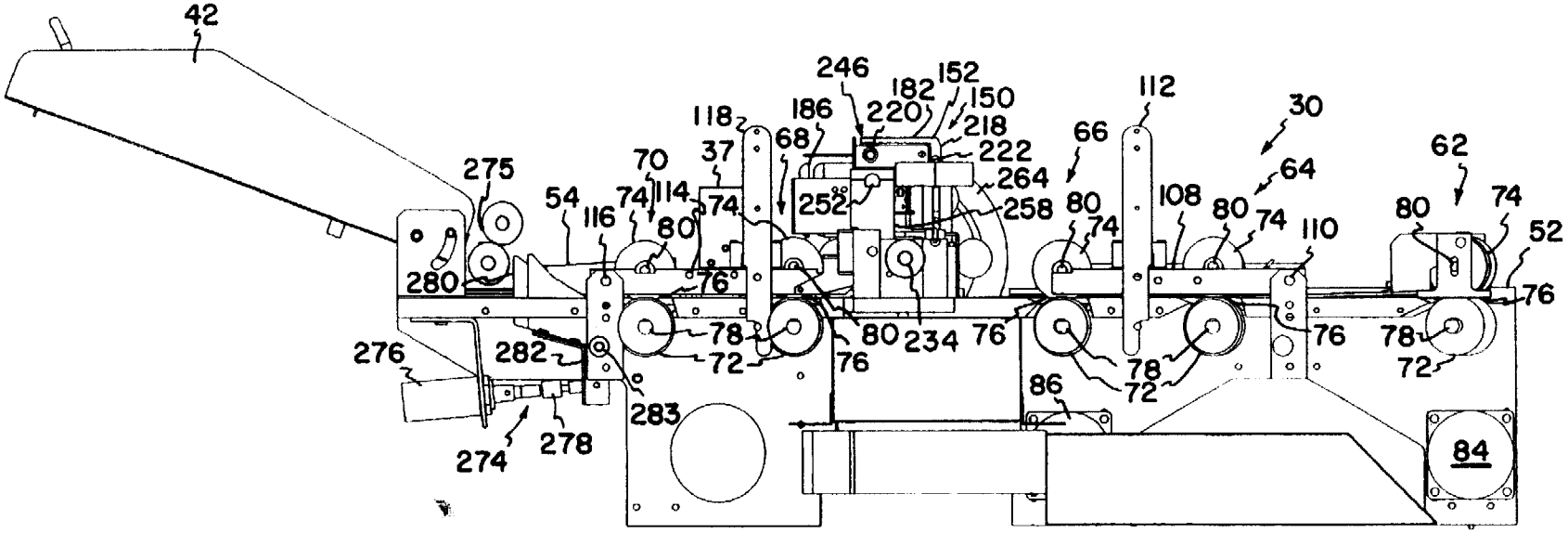
FIG. 3 is a front view of the card affixing module shown in FIG. 2.

As best shown in FIG. 3, each of the roller units 62, 64, 66, 68, 70 has a solid lower roller 72 positioned directly below and in rolling contact with a plurality of aligned upper rollers 74. The lower rollers 72 are generally horizontal and extend lengthwise between the first side plate 56 and the second side plate 58 of the affixing module 30. The upper rollers 74 are aligned along an axis which is parallel to the lower rollers 72. The upper lip 60 which functions as a form guide is punched to provide side clearance for the lower rollers 72 and the aligned upper rollers 74. There is line contact between the lower rollers 72 and the upper rollers 74 which define form transfer nips 76 through which form 22 is fed.

The lower rollers 72 are rigidly mounted on lower shafts 78 which rotatedly extend through the first side plate 56 and the second side plate 58. The lower rollers 72 are made of rubber or a similar material. The aligned upper rollers 74 are individually rotatedly mounted on upper shafts 80 which are connected to the affixing module 30 at a location above the first side plate 56 and the second side plate 58. The upper rollers 74 are idle rollers and are made of an extremely compliant material such as plastic or soft foam.

In order for the form transport units 62, 64, 66, 68, 70 to properly transport the form 22, the lower roller 72 of each unit 62, 64, 66, 68, 70 must be rotated. As best shown in FIG. 2, the lower rollers 72 are rotated by applying a torque to drive sheaves 75 which are rigidly mounted on the lower roller shafts 78. Because the lower rollers 72 are in rolling contact with the aligned upper rollers 74, the rotation of the lower rollers 72 causes the aligned upper rollers 74 to rotate. As form 22 enters the form transfer nips 76 between the lower rollers 72 and the upper rollers 74, the rotating lower rollers 72 grip the form 22 and propel it downstream.

As best shown in FIGS. 2 and 3, the first roller unit 62 is driven by a first drive belt 82 adjacent to the first side plate 56 which transfers torque from a first drive motor 84 to the lower roller 72 of the first roller unit 62. As also shown in FIGS. 2 and 3, the second, third, fourth, and fifth roller units 64, 66, 68, 70 are driven by a second drive motor 86 through the use of second drive belt 88, a third drive belt 90, a fourth drive belt 92 and a fifth drive belt 94. The second drive belt 88 is adjacent to the first side plate 56 and transfers torque from the second drive motor 86 to the third roller unit 66 lower roller 72. The third drive belt 90 transfers torque from the third roller unit 66 lower roller 72 to the second roller unit 64 lower roller 72. The fourth drive belt 92 transfers torque from the third roller unit 66 lower roller 72 to the fourth roller unit 68 lower roller 72. The fifth drive belt 94 transfers torque from the fourth roller unit 68 lower roller 72 to the fifth roller unit 70 lower roller 72.

The first drive motor 84 and the second drive motor 86 are electrically controlled by the card affixing module local module processor (not shown). The affixing module local module processor (not shown) sends motor control commands which control the operation of the first drive motor 84 and the second drive motor 86 which drive the roller units 62, 64, 66, 68, 70. This computer control allows the roller units 62, 64, 66, 68, 70 to move the form 22 in precisely controlled small increments along the length 35 of the card affixing module 30.

Mounted at set locations along the first side plate 56 and the second side plate 58 at a level approximately equal to the level of the upper lip 60 are a plurality of affixer paper sensing photocells 120. The paper sensing photocells 120 detect the leading and trailing edges of a form 22 being transferred by the roller units 62, 64, 66, 68, 70 and are electronically connected to the affixing module local module processor (not shown). When the leading or trailing edge of a form is detected, the affixer paper sensing photocells 120 send an electronic machine control signal to the local module processor (not shown) which processes the signal and uses the information to precisely control the downstream or upstream location of the form 22 by sending motor control commands to the first drive motor 84 and the second drive motor 86. In this way, the local module processor (not shown) is able to constantly monitor and control the exact location of each form 22 that is within the card affixing module 30.

Referring now to FIG. 2, the first two roller units 62, 64 are horizontally aligned so that their lower roller shafts 78 and upper roller shafts 80 do not form an exact 90 degree angle with the first side plate 56 upper lip 60. Instead, the lower roller shafts 78 and upper roller shafts 80 are skewed slightly towards the downstream end 54 of the card affixing module 30. Because the lower roller shafts 78 and upper roller shafts 80 are skewed downstream relative to the upper lip 60, the lower rollers 72 and upper rollers 74 are skewed toward the first side 56 relative to the direction of the form 22 travel. The skewed nature of the lower rollers 72 and upper rollers 74 biases the form 22 against the first side plate 56 upper lip 60. By biasing the form 22 against the upper lip 60 which serves as a form guide, any drifting of the form 22 is eliminated thereby allowing precise form location to be maintained.

In the embodiment shown in FIG. 2, the first roller unit 62 is skewed an angle of 2 degrees and the second roller unit 64 is skewed an angle of 0.5 degrees relative to the direction of the form 22 travel. Although specific angles of skew are depicted in this embodiment, it will be appreciated that in alternate embodiments of this invention, the angles of skew for the roller units 62, 64 can be varied from those specifically depicted. Additionally, the third and fourth roller units 66, 68 can also be skewed relative to the direction of the form 22 travel.

Referring again to FIG. 2, positioned closely between the first roller unit 62 and the second roller unit 64 is a horizontal generally rectangular first bottom plate (not shown). Positioned closely between the second roller unit 64 and the third roller unit 66 is a horizontal generally rectangular second bottom plate (not shown). Positioned closely between the third roller unit 66 and the fourth roller unit 68 is a horizontal generally rectangular third bottom plate 100. Positioned closely between the fourth roller unit 68 and the fifth roller unit 70 is a horizontal generally rectangular fourth bottom plate (not shown). Positioned closely between the fifth roller unit 70 and the downstream end 54 of the card affixing module 30 is a horizontal generally rectangular fifth bottom plate 104.

Each of the five bottom plates is connected to the first side plate 56 and the second side plate 58 at a location slightly below the upper lip 60 of the first side plate 56. The bottom plates guide the form 22 as it is transferred between the rollers units 62, 64, 66, 68, 70.

As shown in FIG. 2, the third bottom plate 100 defines a plurality of circular holes 106. Located directly below the third bottom plate 100 is a source of vacuum (not shown) which is in communication with the plurality of holes 106. The source of vacuum (not shown) creates low pressure areas above each hole 106. In this way, the holes 106 provide suction which holds the form 22 against the bottom plate 100 thereby preventing curling of the form 22 and reducing the opportunity for form 22 jams.

Located at a position parallel to and slightly above the first bottom plate (not shown) is a generally rectangular entrance top guide plate 95.

Located at a position parallel to and slightly above the second bottom plate (not shown) is a first generally rectangular top guide plate 97. Located at a position parallel to and slightly above the fourth bottom plate (not shown) is a second generally rectangular top guide plate 99. The top guide plates 95, 97, 99 hold the form 22 against the bottom plates thereby preventing buckling or skewing of the form 22 as it is transferred through the affixing module 30. The top guide plates 95, 97, 99 are particularly important because as the form is biased against the upper guide lip 60, it has a natural tendency to skew or buckle. This buckling tendency is neutralized by the upper guide plates 95, 97, 99.

Referring to FIG. 3, the second roller unit 64 and third roller unit 66 upper roller shafts 80 are connected to a first frame 108 positioned above the second bottom plate (not shown). The first frame 108 is connected to the first side plate 56 and the second side plate 58 by a first pair of rotatable hinges 110. The first top guide plate 97 is also connected to the first frame 108 at locations adjacent to the first side plate 56 and the second side plate 58. A first handle 112 is connected to the first frame 108. By pulling on the handle 112, the first frame 108 is caused to rotate upward like a clam shell about the first pair of hinges 110 thereby raising the second roller unit 64 upper rollers 74, the first top guide plate 97 and the third roller unit 66 upper rollers 74. This provides interior access to the second and third roller units 64, 66 in order to clear jams.

The fourth roller unit 68 and fifth roller unit 70 upper roller shafts 80 are mounted on a second frame 114 positioned above the fourth bottom plate (not shown). The second frame 114 is connected to the first side plate 56 and the second side plate 58 by a second pair of rotatable hinges 116. The second top guide plate 99 is also connected to the first frame 108 at locations adjacent to the first side plate 56 and the second side plate 58. A second handle 118 is connected to the second frame 114. By pulling on the handle 118, the second frame 114 is caused to rotate upward like a clam shell about the second pair of hinges 116 thereby raising the fourth roller unit 66 upper rollers 74, the second top guide plate 99, and the fifth roller unit 70 upper rollers 74. This provides interior access to the fourth and fifth roller units 68, 70 in order to clear jams.

Positioned between the third roller unit 66 and the fourth roller unit 68 is a card carriage mechanism 150 which receives the cards 34 from the sticker module 158.

The card carriage mechanism 150 is the component of the card affixing module 30 that actually affixes the card 34 to the form 22. The card 34 is affixed to the form 22 by using an adhesive strip 160 which is attached to the back side 31 of the card 34 while the card 34 is in the sticker module 158. The adhesive strip 160 has a heat sensitive adhesive side and a pressure sensitive adhesive side. It will be appreciated that while in the embodiment shown only an adhesive strip 160 having a heat sensitive side and pressure sensitive side is described, in alternate embodiments, different card affixing means may be utilized.

The heat sensitive adhesive side is used to bond the adhesive strip 160 to the back side 31 of the card 34 while the card 34 is in the sticker module 158. The pressure sensitive adhesive side of the adhesive strip 160 is used to bond the adhesive strip 160 to the form 22 thereby effectively affixing the back side 31 of the card 34 to the form 22. The card carriage mechanism 150 functions to press the back side 31 of the card 34 against the form 22 thereby causing the pressure sensitive adhesive of the adhesive strip 160 to bond to the form 22.

Figure 4:
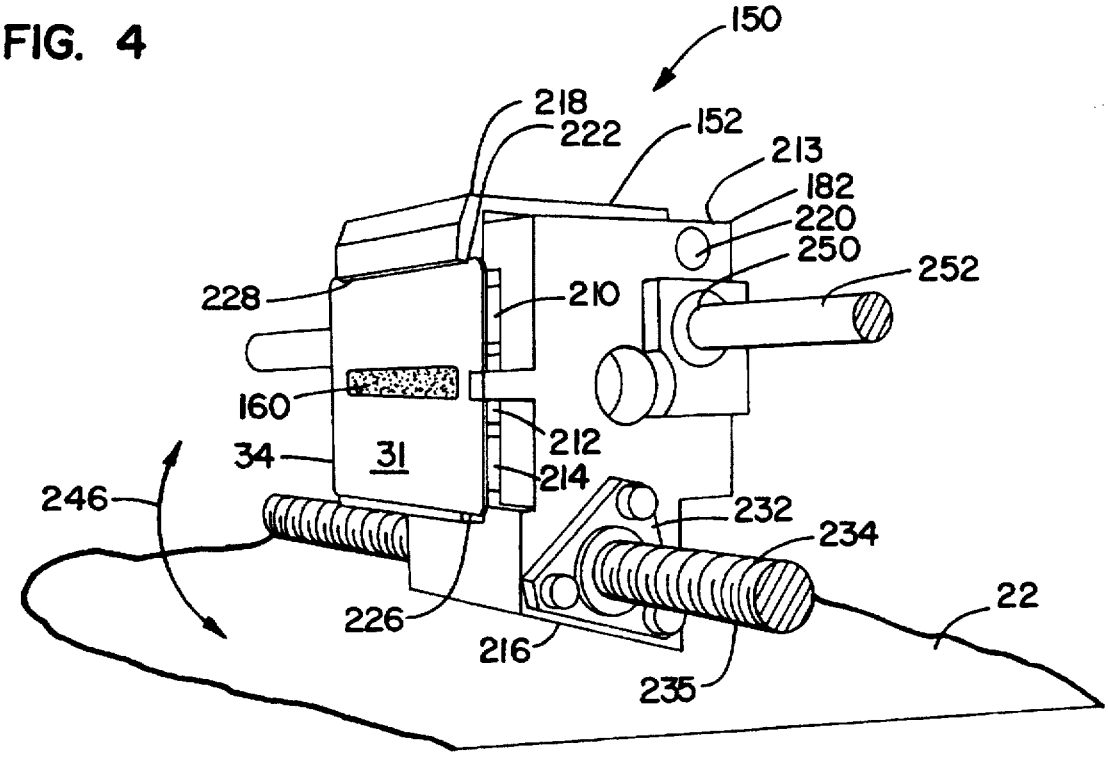
FIG. 4 is a perspective view of the card carriage shown in FIGS. 2 and 3.
Figure 5:
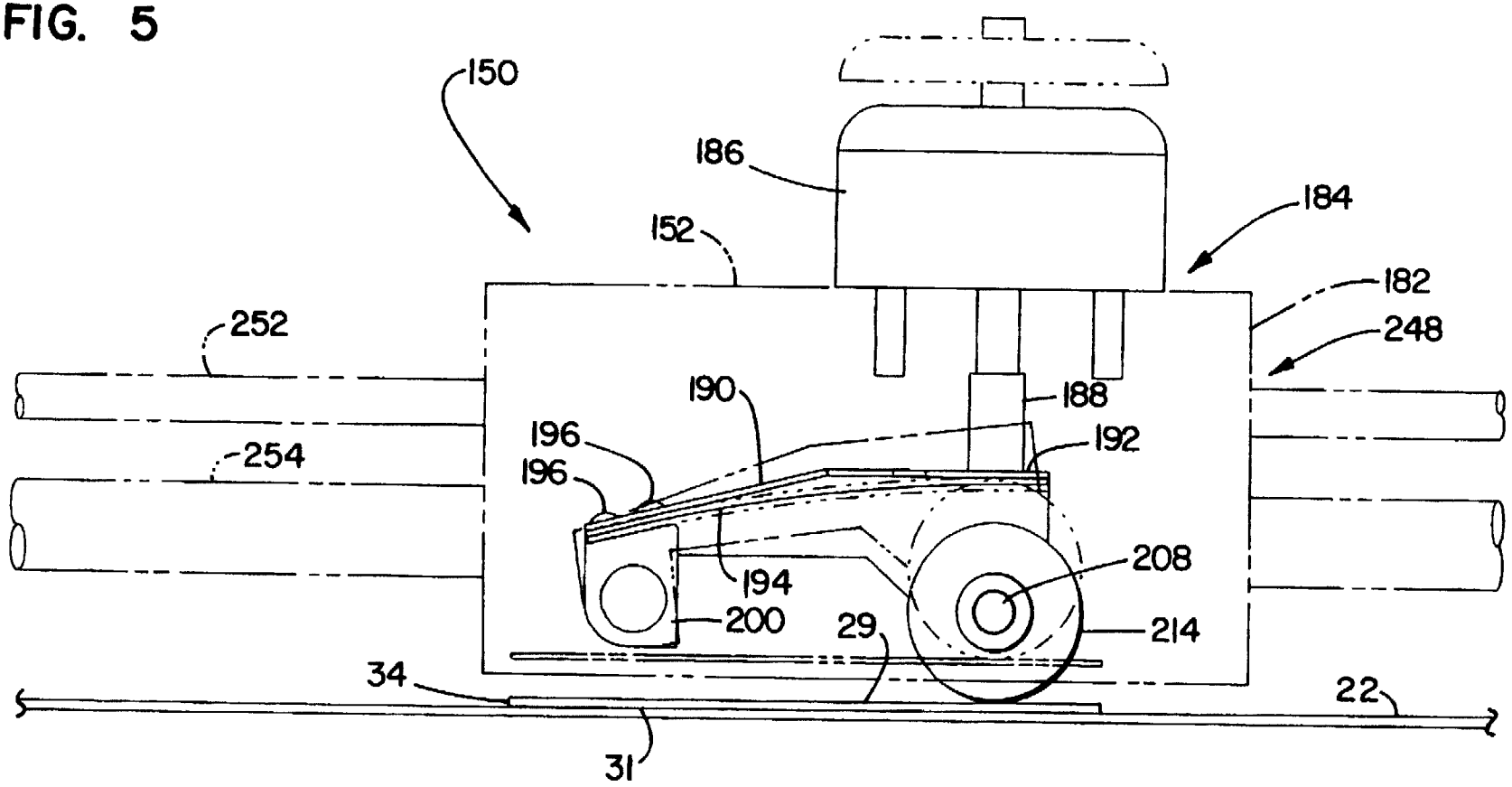
FIG. 5 is a view of the card carriage of claim 4 from the upstream end of the card affixing module, in this view the card carriage is in the card affixing position and the casing of the card carriage is shown in dash line to better illustrate the card rolling mechanism held by the card carriage.

Referring to FIG. 4, the card carriage mechanism 150 has a card carriage 152 having a generally cubical housing 182. Referring to FIG. 5, the card carriage 152 holds a solenoid actuated card rolling mechanism 184. The card rolling mechanism 184 has a solenoid 186 which drives a cylindrical plunger 188. Positioned adjacent to the plunger 188 is a lever arm 190. The lever arm 190 defines a circular hole 192 that is aligned to receive the plunger 188. The diameter of the hole 192 is slightly larger than the diameter of the plunger 188. Separated from the plunger 188 by the lever arm 190 is a double leaf spring 194. The lever arm 190 and the double leaf spring 194 are connected to each other at one end by a pair of screws 196 which jointly connect the double leaf spring 194 and the lever arm 190 to a pivot member 200.

Figure 6:
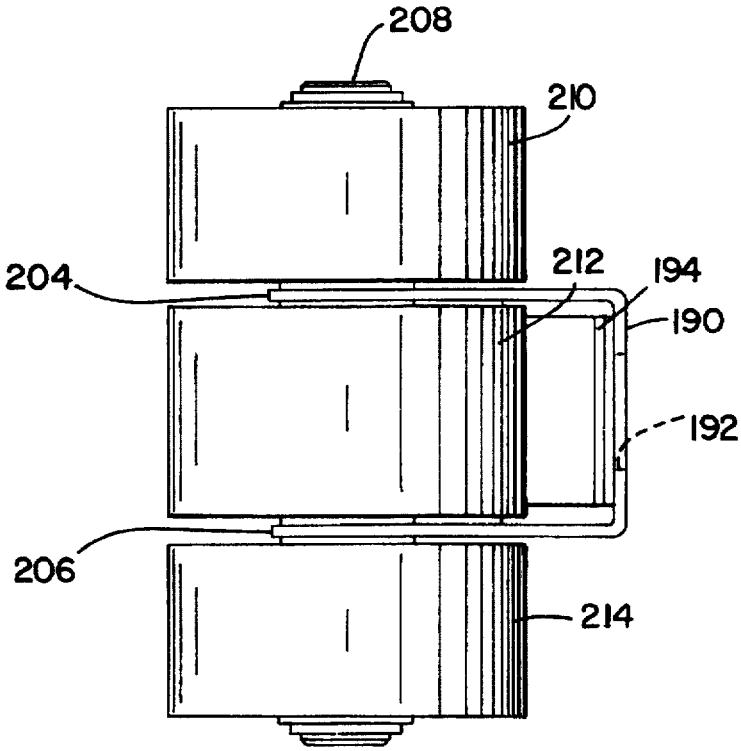
FIG. 6 is a side view of the rollers of the card rolling mechanism of FIG. 5.

As shown in FIG. 6, the lever arm 190 has a U-shaped cross section defined by a first extension arm 204 and a second extension arm 206. The first and second extension arms 204, 206 straddle the double leaf spring 194 and extend away from the plunger 188. The extension arms 204, 206 are made of stainless steel or a like material and have sufficiently narrow cross sections to allow them to flex when subjected to uneven axial loads. The ends of the extension arms 204, 206 are rigidly and perpendicularly connected to a cylindrical shaft 208. A first outside roller 210, a middle roller 212 and a second outside roller 214 are rotatedly mounted on the shaft 208. The rollers 210, 212, 214, are made of rubber or a similarly resilient material. The first extension arm 204 and the second extension arm 206 straddle the middle roller 212.

The jointly pivoted lever arm 190 and double leaf spring 194 work as a pressure relief mechanism which prevents the solenoid 186 from exerting too much pressure on the rollers 210, 212, 214. When the solenoid 186 is actuated, the solenoid plunger 188 extends outward toward lever arm 190, passes through the hole 192 in the lever arm 190 and exerts a force on the double leaf spring 194. The force on the double leaf spring 194 causes the double leaf spring 194 and the jointly attached lever arm 190 to rotate about the pivot member 200. As the lever arm rotates about the pivot member 200, it exerts a force on the U-shaped bracket 202 which transfers the force to the rollers 210, 212, 214. If the force on the rollers 210, 212, 214 reaches the overload point, the double leaf springs 194 begin to flex rather than transfer additional torque to the lever arm 190. In this way, the double leaf spring 194 and lever arm 190 work as a pressure relief mechanism.

Referring again to FIG. 4, the card carriage 152 has a top side 213 opposite a bottom side 216. Located at the top side 213 is a top member 218. The top member 218 is rotatedly mounted on a hinge pin 220 thereby enabling the top member 218 to pivot about the hinge 220. At the end opposite from the hinge pin 220, the top member 218 defines a upper slanted surface 222 which operates as a card guide. As shown in FIG. 2, the top member 218 is connected to a spring 224. The spring 224 exerts a downward force on the top member 218 thereby downwardly biasing the top member 218. In this way, any upward rotation of the top member 218 about the hinge 220 pin is resisted by the spring 224. In effect, the top member 218 is spring loaded.

Referring again to FIG. 4, located adjacent to the bottom side 216 of the card carriage 152 is a lower slanted surface 226 which operates as a lower card guide. The lower slanted surface 226 is aligned below the upper slanted surface 222. The card carriage 152 has a generally rectangular outer opening 228 having dimensions approximately equal to the dimensions of the card 34. The outer opening 228 is adjacent to the card rollers 210, 212, 214 and has its upper boundary defined by the upper slanted surface 222 and its lower boundary defined by the lower slanted surface 226. The two surfaces 226, 222 cooperate to guide and hold the cards 34 which are fed from the sticker module 158.

The card carriage 152 has a lead screw nut 232 positioned adjacent to the bottom side 216 of the carriage 152. As best shown in FIG. 4, the lead screw nut 232 is threadingly mounted on a lead screw 234 having radial threads 235.

Figure 7:
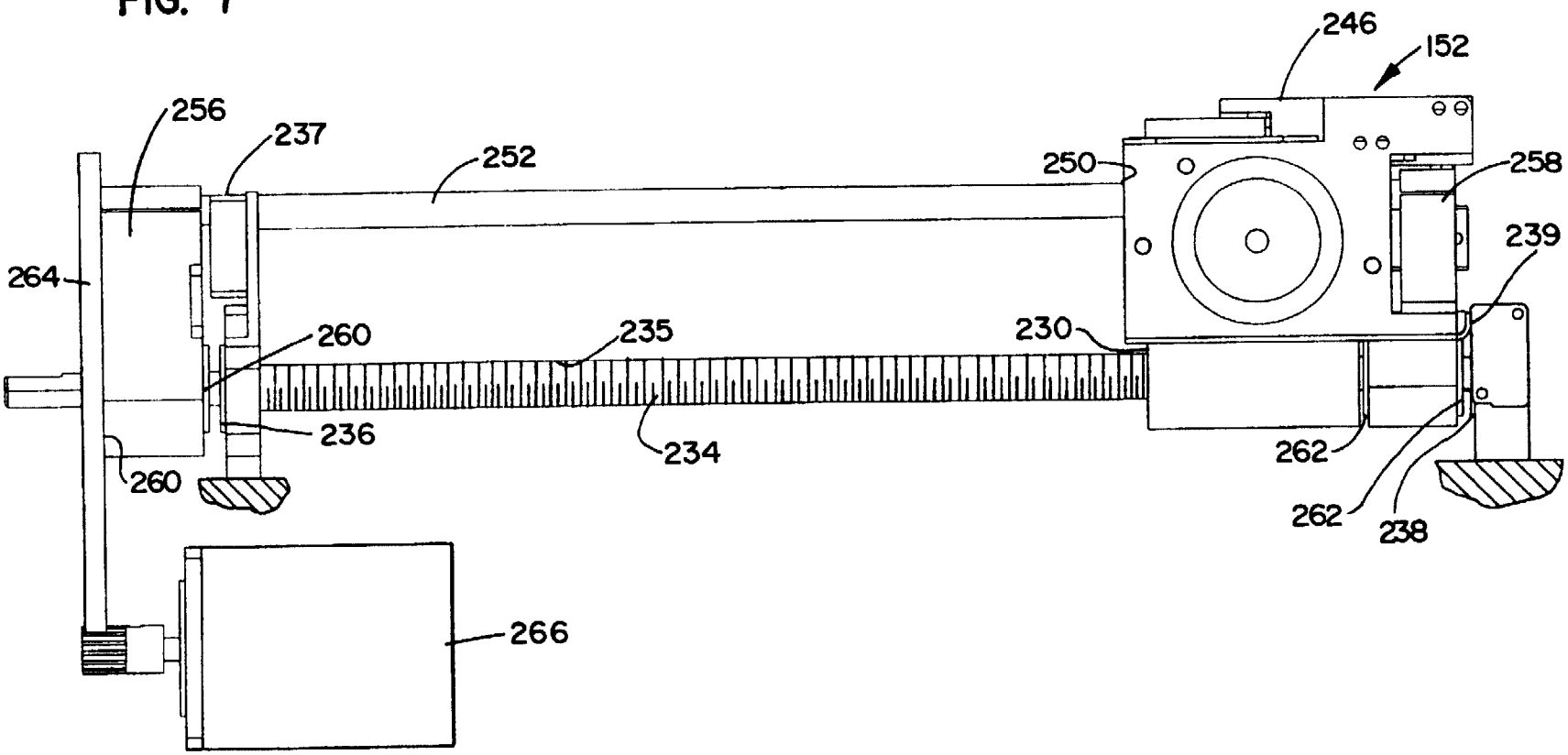
FIG. 7 is a side view of the card affixing mechanism of FIGS. 2 and 3 as viewed from the downstream end of the affixing module.

Referring to FIG. 7, the lead screw 234 is aligned across the width 35 of the affixing module 30 and extends from a first fixed bearing 236 located adjacent to the first side plate 56 to a second fixed bearing 238 located adjacent to the second side plate 58. The lead screw 234 is rotatable within the two fixed bearings 236, 238. The fixed bearings 236, 238 support the lead screw 234 and also resist axial movement of the lead screw 234.

As shown in FIGS. 2, 3, 4 and 7, the card carriage mechanism 150 has a home position 246 in which the card 34 being held by the card carriage 152 is aligned substantially within a vertical plane.

As shown in FIG. 5, the card carriage mechanism 150 also has a card affixing position 248 rotated approximately 90 degrees about the lead screw 234 relative to the home position 246. In the card affixing position 248, the card 34 being held by the card carriage 152 is aligned substantially within a horizontal plane. Additionally, the back side 31 of the card 34 being held by the card carriage 152 is adjacent and parallel to the form 22 being transferred.

Referring again to FIGS. 4 and 7, the card carriage 152 defines a cylindrical bore 250 which is located adjacent to the top member hinge pin 220. Inserted through the cylindrical bore 250 is a cylindrical bearing shaft 252. The bearing shaft 252 is aligned parallel to the lead screw 234 and extends from a first bearing frame 256 located adjacent to the first side plate 56 to a second bearing frame 258 located adjacent to the second side plate 58. The first bearing frame 256 is rotatedly mounted on the lead screw 234 by a first pair of bearings 260 which are adjacent to the first fixed lead screw bearing 236. The second bearing frame 258 is rotatedly mounted on the lead screw 234 by a second pair of bearings 262 which are adjacent to the second fixed lead screw bearing 238. The card carriage 152 is free to slide along the length of the bearing shaft 252.

The first bearing frame 256 is rigidly connected to a bearing shaft drive gear 264 which is rotatedly mounted on the lead screw 234 by bearings 260. The bearing shaft drive gear 264 engages and is driven by a rotary stepper motor 266 which is controlled by the affixing module local processor (not shown). Because the drive gear 264 is rigidly connected to the bearing shaft 252 by the first bearing frame 256, the rotation of the drive gear 264 causes the bearing shaft 252 to revolve about the lead screw 234 which causes the card carriage 152 to rotate about the lead screw 234. For example, when the card carriage 152 is in the home position 246, the rotary drive motor 266 drives the bearing shaft drive gear 264 in a first direction thereby causing the card carriage 152 to rotate about the lead screw 234 in a first direction until it reaches the card affixing position 248. When the card carriage 152 is in the card affixing position 248, the rotary drive motor 266 drives the bearing shaft drive gear 264 in a second direction thereby causing the card carriage 152 to rotate about the lead screw 234 in a second direction until it returns to the home position 246. A first carriage sensor 237 positioned adjacent to the first bearing frame 256 detects when the carriage 152 is in the home position 246. This allows the count of the rotary stepper motor 266 to be repeatedly reset as the carriage 152 returns to the home position 246.

Referring to FIG. 2, a carriage drive sheave 240 is rigidly mounted on the lead screw 234 adjacent to the first side plate 56. The carriage drive sheave 240 is connected to a card carriage stepper motor 242 by a card carriage drive belt 244. The card carriage stepper motor 242 is controlled by motor control signals generated by the local module processor (not shown) and drives the card carriage drive belt 244 which exerts a torque on the carriage drive sheave 240 thereby rotating the lead screw 234.

When the lead screw 234 is rotated by the stepper motor 242 in a first direction, the carriage 152 is restrained from rotating with the lead screw 234 by the bearing shaft 252. The lead screw 234 rotating in the first direction within the lead screw nut 232 causes the carriage 152 to be translated by the lead screw threads 235 axially along the lead screw 234 towards the first side plate 56. When the lead screw 234 is rotated by the stepper motor 242 in a second direction, the carriage 152 is again restrained from rotating within the lead screw 234 by the bearing shaft 252. The lead screw 234 rotating in the second direction within the lead screw nut 232 causes the carriage 152 to be translated by the lead screw threads 235 axially along the lead screw 234 towards the second side plate 58. Since the lead screw 234 is rotated by the stepper motor 242 which is controlled by the affixing module local processor (not shown), the position of the carriage 152 along the width 37 of the affixing module 30 is precisely controlled.

Because the carriage 152 is slidingly mounted on the bearing shaft 152, the bearing shaft 152 provides almost no resistance to the translation of the carriage 152 axially along the lead screw 234. Additionally, a second carriage sensor 239, as shown in FIG. 7, located adjacent to the second fixed bearing 238, detects the presence of the carriage 152 when it is directly adjacent to the second fixed bearing 238. This allows the count of the carriage stepper motor 242 to be repeatedly reset.

In operation, the computer operator (not shown) enters data into the system controller 36 which send data and configuration commands to the affixing module local processor (not shown). In response, the affixing module local processor sends motor control commands to the first and second form roller drive motors 84, 86 which cause the form roller units 62, 64, 66, 68, 70 to transfer the form 22 through the card affixing module 30. The roller units 62, 64, 66, 68, 70 position and stop the form 22 beneath the card carriage mechanism 150. The roller units 62, 64, 66, 68, 70 can be rotated in very small increments so the upstream 52 and downstream 54 location of the form 22 beneath the card carriage mechanism 150 can be precisely controlled. This precise control of the roller units 62, 64, 66, 68, 70 allows the cards 34 to be affixed at exact locations along the length of the form 22.

Once the form 22 is stopped at the proper location, it is held in place with the help of the vacuum (not shown) which communicates with the form 22 through the vacuum holes 106 in the third bottom plate 100. The vacuum holes 106 prevent the edges of the form 22 from curling and hold the form 22 in place as the card 34 is affixed to the form 22.

At the time the form 22 is being positioned beneath the card carriage mechanism 150, the card carriage 152 is in the home position 246. At the same time, the card 34 having the adhesive strip 160 attached is being simultaneously fed from the sticker module 158 into the card carriage 152. The card 34 is guided from the sticker module 158 into the upper slanted surface 222 and the bottom slanted surface 226 of the card carriage 152. The spring 224 loaded top member 218 biases the upper slanted surface 222 down upon the card 34 thereby holding it firmly in place. The front side 29 of the card 34 faces the card rollers 210, 212, 214, of the card rolling mechanism 184 while the back side 31 of the card 34 faces the outer opening 228 of the carriage 152.

Once the card 34 is within the carriage 152, the affixing module local processor (not shown) signals the carriage drive motor 242 to rotate the lead screw 234 in a first direction which causes the carriage 152 to translate axially along the lead screw 234 towards the first side plate 56 of the affixing module 30. The lead screw 234 can be rotated in very small increments by the card carriage stepper motor 242 so the position of the carriage 152 on the lead screw 234 can be precisely controlled by the affixing module local processor (not shown). This precise control of the lead screw 234 allows the cards 34 to be affixed at exact locations along the width of the form 22.

Once the card carriage 152 is positioned in the proper location on the lead screw 234, the affixing unit local processor (not shown) signals the rotary stepper motor 266 to rotate the card carriage 152 from the home position 246 to the card affixing position 248. As best shown in FIG. 5, when the carriage 152 reaches the card affixing position 248, the card rolling mechanism solenoid 186 is energized causing the solenoid plunger 188 to extend perpendicularly towards the form 22. The extended plunger 188 causes the rollers 210, 212, 214 to contact the front 29 of the card 34 and push it out of the carriage 152 and onto the form 22.

As the solenoid 186 is energized, the affixing module local processor (not shown) signals the carriage stepper motor 242 to rotate the lead screw 234 in a second direction which causes the carriage 152 to translate along the lead screw 234 axially towards the second side plate 58 of the affixing module 30. This causes the extended rollers 210, 212, 214 to roll lengthwise across the front 29 of the card 34. As the rollers 210, 212, 214 roll across the card 34, they exert a line force on the front 29 of the card 34 which forces the card 34 out of the outer opening 228 of the carriage 152 and onto the form 22. As the line force moves across the entire surface of the card 34, it causes all of the pressure sensitive adhesive to bond to the form 22 thereby securely affixing the card 34 to the form 22.

Additionally, as the rollers 210, 212, 214, roll across the card 34, the U-shaped bracket 202 of the card rolling mechanism 184 allows the rollers 210, 212, 214, to flex and conform to any aberrations on the front 29 of the card 34 such as embossing. This gimballing of the rollers 210, 212, 214, ensures that the rollers 210, 212, 214, exert a uniform force across the card 34 which prevents skewing of the card 34 and induces complete bonding of all pressure sensitive adhesive to the form 22.

De-embossing of the card 34 and imprints on the form 22 are avoided because the rollers 210, 212, 214 exert a line force which requires less solenoid 186 pressure to bond the pressure sensitive adhesive to the form 22 than is needed by traditional area force bonding mechanisms. Additionally, the jointly pivoted leaf spring 194 and lever arm 190 act as a pressure relief mechanism.

After the card 34 is affixed to the form 22, the carriage 152 continues to translate axially along the lead screw 234 while simultaneously rotating about the lead screw 234 towards the home position 246. When the carriage 152 is at the home position 246 adjacent to the second side plate 58 of the affixing mechanism 30, it receives another card 34 from the sticker module 158 and repeats the above described process.

It will be appreciated that while in the embodiment shown and described the form 22 movement is only in the horizontal direction, in alternate embodiments, movement of the form 22 might be vertical or slanted. Additionally, while in the embodiment shown a lead screw 234 is used to translate the card carriage 152 across the width of the card affixing mechanism 30, in alternate embodiments, the card carriage 152 could be moved by other translation mechanisms. Moreover, although in the embodiment shown the card carriage 152 is rotated from the home position 246 to the card affixing position 248 by a driven drive gear 264, in alternate embodiments the cards 34 might be fed from the sticker module 158 to the card carriage 152 in a horizontal plane while the card carriage 152 is in the card affixing position 248. Such an alteration would allow the card carriage 152 to constantly remain in the card affixing position 248 thereby eliminating the need for the card carriage 152 to rotate about the lead screw 234 from the home position 246 to the card affixing position 248. Furthermore, rollers 210, 212, 214 could be replaced by any number of rollers. For example, a single roller (not shown) could be used. In the case of a single roller (not shown), the extension arms 204, 206 of the U-shaped bracket 202 would straddle the entire roller (not shown). This configuration would gimbal the roller (not shown) thereby allowing it to flex to balance uneven axial stresses on the card 34.

Figure 8:
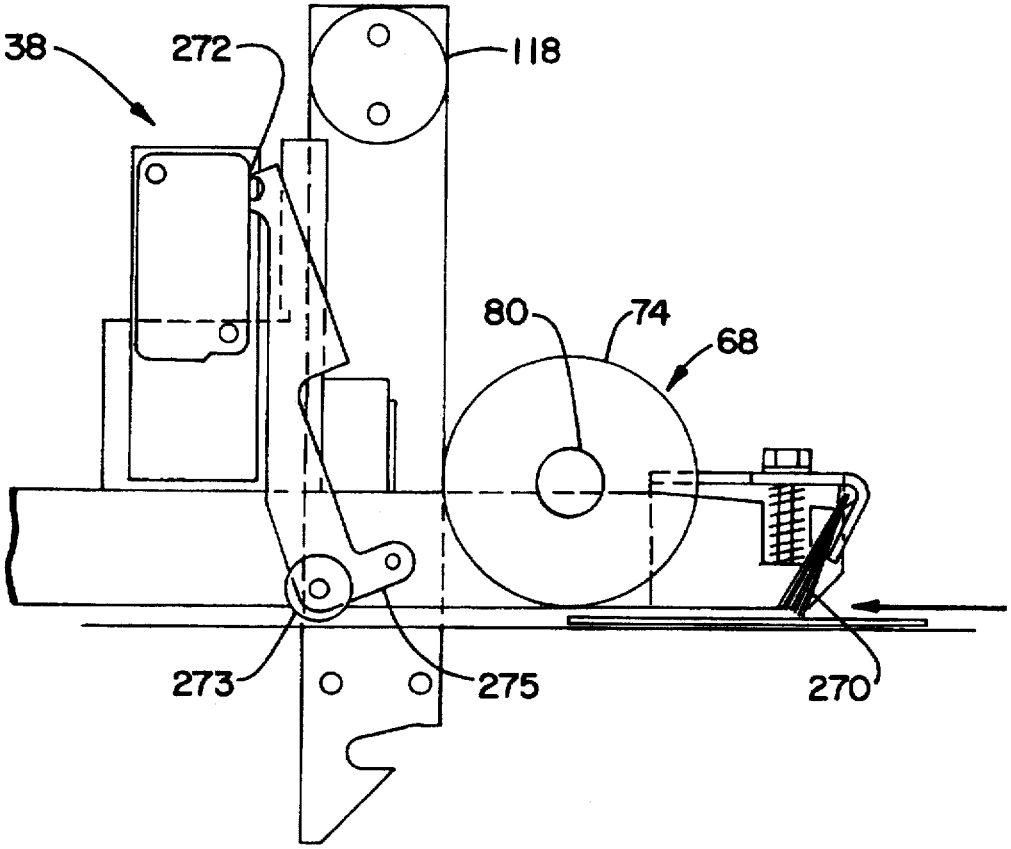
FIG. 8 is an side view of the card verification sensor, the brush and the form diversion mechanism of the card affixing mechanism of FIGS. 2 and 3.

Referring to FIG. 8, positioned downstream from the card carriage mechanism 150 is a brush 270 which extends from the first side plate 56 to the second side plate 58 of the card affixing module 30. The brush 270 contacts the form 22 being transferred by the card affixing module 30 and removes any cards 34 which are inadequately affixed. Although the preferred embodiment depicts a the use of the brush 270 to remove inadequately affixed cards 34, the scope of this invention includes other mechanisms which serve the same purpose such as flexible protruding fingers or forced air.

Positioned downstream from the brush 270 located between the fourth roller unit 68 and the fifth roller unit 70 is the card verification sensor 38. Referring to FIG. 8, the card verification sensor 38 extends from the first side plate 56 to the second side plate 58 of the card affixing module 30. The card verification sensor 38 has two switches 272 which are evenly spaced between the first side plate 56 and the second side plate 58 of the card affixing module 30. The switches 272 each have a roller 273 connected to a pivot arm 275. The switches 272 are positioned directly above the form 22 being transferred through the card affixing module 30 and are electronically connected to the affixing module local processor (not shown).

When a form 22 carrying a card 34 passes under the card verification sensor 38, the card 34 contacts one of the rollers 273. Upon contact with the card 34, the roller 273 and pivot arm 275 are pushed upward thereby actuating the switch 272. When the switch 272 is actuated, a machine control signal is electronically sent to the affixing module local processor (not shown) which interprets the signal and counts and verifies the position of the affixed card 34.

However, if a card 34 is inadequately affixed and therefore removed by the brush 270, the form 34 passes under the card verification sensor 38 without triggering any contact switches 272. In this situation, the affixing module local processor recognizes that an error has occurred in the affixing process. As a result, the affixing module local processor immediately shuts down the card affixing module 30 thereby allowing an operator (not shown) to remove the defective card 34 and form 22. In this way, the verification sensor 38 helps monitor quality control while simultaneously preventing jams or damage to the card affixing module 30 or downstream folding module 40 that could be caused by loose cards 34.

Referring again to FIGS. 2 and 3, positioned downstream from the fifth roller unit 70 is the form holding tray 42. The form holding tray 42 works in combination with a form diversion mechanism 274 which diverts the form 22 into the holding tray 42. The form diversion mechanism 274 is electronically connected to the affixing module local processor (not shown) and is activated when the operator (not shown) enters the appropriate data into the system controller 36.

Referring to FIG. 3, the form diversion mechanism 274 has a diversion solenoid 276 positioned below the path of form 22 travel of the card affixing module 30. The diversion solenoid 276 has a plunger 278 connected to a plurality of sloped diversion guide members 280 by a hinged member 282. The hinged member is rotatedly connected to the plunger 278 and rigidly connected to the sloped guide members 280. The sloped guide members 280 are rotatedly mounted on a guide member shaft 283 which is aligned below the form 22 path.

When the diversion solenoid 276 is actuated, the plunger 278 is pulled away from the sloped diversion guide members 280 thereby causing the guide members 280 to rotate about the guide member shaft 283 and swing upward into the form 22 path. When the diversion solenoid 276 is de-activated, the plunger 278 is pushed toward the sloped diversion guide members 280 thereby causing the guide members 280 to rotate about the guide member shaft 282 and swing downward out of the form 22 path.

As shown in FIG. 2, located above the form path and the diversion mechanism 274 is an exit roller mechanism 275. The exit roller mechanism 275 receives forms 22 from the guide members 280 and propels the forms 22 in a bowed fashion into the form holding tray 42.

The exit roller mechanism 275 has a plurality of compliant upper rollers 277 mounted on a straight shaft 279. Mounted below the upper rollers 277 is a single arcuate roller 301 mounted on a straight shaft 303. A center portion 286 of the arcuate roller 301 is made of rubber or a similar material and is driven by the shaft 303. The outer portions 305 of the arcuate roller 301 are made of plastic or a like material and are free to rotate about the shaft 303. In this way, the form 22 is driven by the center portion 286 and is bowed by the outer portions 305. It is important that the outer portions 305 not be driven because diameter variations between the center portion 286 and the outer portions 305 would cause variations in the surface velocities of the portions 286, 305. The surface velocity variations would skew the form 22 as it is fed between the upper rollers 277 and the lower arcuate roller 301.

In operation, the diversion solenoid 276 causes the sloped guide members 280 to swing up into the path of the form 22. The form 22 that is to be diverted slides up the guide members 280 and is fed into the exit roller mechanism 275 which bows the form 22. The bowed form 22 is propelled by the exit roller mechanism 275 into the form holding tray 42.

Because the form 22 is bowed as it enters the form holding tray 42, it resists bending downward and is much less likely to become caught on cards 34 that are affixed to the forms 22 that are already in the holding tray 42.

It will be appreciated that alternative exit roller mechanisms could be used to propel forms 22 in a bowed fashion into the form holding tray 42. For example, upper segmented rollers mounted on a bowed shaft over lower rollers having varying diameters to complement the bow of the upper shaft would serve as an alternative embodiment for a exit roller mechanism.

If the form 22 is not diverted to the form holding tray 42, it is transferred to the folding module 40 which folds the form 22 with the cards 34 remaining attached. The following is a general embodiment of a folding mechanism 40A which illustrates the principles utilized by this invention to enable the form 22 to be folded with the cards 34 affixed. Thereafter, the detailed structure of the preferred embodiment of the folding module 40 will be described.

Figure 9A:
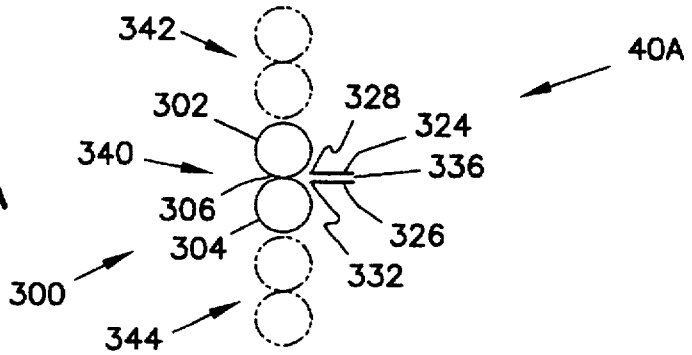
FIG. 9A is a side view of a general embodiment of a folding mechanism.

Referring to FIG. 9A, there is illustrated a general embodiment of the folding mechanism 40A in accordance with the principles of this invention. The general embodiment of the folding mechanism 40A has a set of fold rollers 300 having a upper fold roller 302 positioned above a lower fold roller 304. A form folding nip 306 is located between the upper and lower fold rollers 302, 304. Each of the rollers 302, 304 is cylindrical, has a length approximately equal to the width of a form 22 and is made of rubber or a like material. Additionally, each of the rollers 302, 304 is connected to a drive source (not shown) which controls the rotation of the rollers 302, 304.

Located adjacent to the set of fold rollers 300 is a upper form guide plate 324 which is positioned above and parallel to a lower form guide plate 326. The upper form guide plate 324 has a upper scoring edge 328 while the lower form guide plate 326 has a lower form scoring edge 332 aligned below the upper scoring edge 328. The upper form guide plate 324 and the lower form guide plate 326 define a gap 336 through which the form 22 is transferred.

The set of fold rollers 300 is connected to a drive source (not shown) which moves the fold rollers 302, 304 vertically upward or downward into one of three basic positions which include the home position 340, the pre-downward fold position 342 and the pre-upward fold position 344.

In the home position 340, the folding nip 306 is aligned adjacent to the gap 336 between the upper guide plate 324 and the lower guide plate 326. In the pre-downward fold position 342, the set of rollers 300 is positioned above the upper scoring edge 328 of the upper form guide plate 324. In the pre-upward fold position 344, the set of rollers 300 is positioned below the lower scoring edge 332 of the lower form guide plate 326.

Figure 9B:
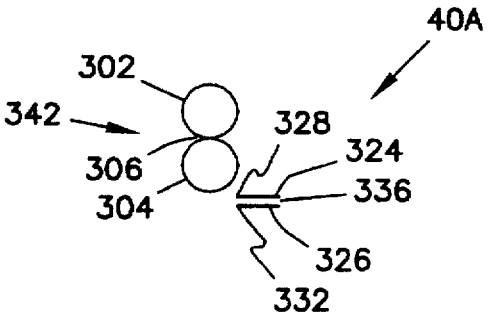
FIG. 9B is a side view of the folding mechanism of FIG. 9A with the rollers in the pre-downward fold position.
Figure 9C:
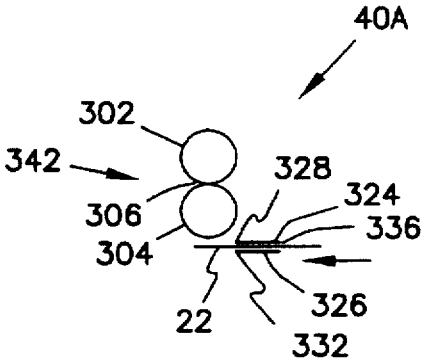
FIG. 9C is a side view of the folding mechanism of FIG. 9A with the in the pre-downward fold position with a portion of a form fed past the scoring edges of the guidance brackets.
Figure 9D:
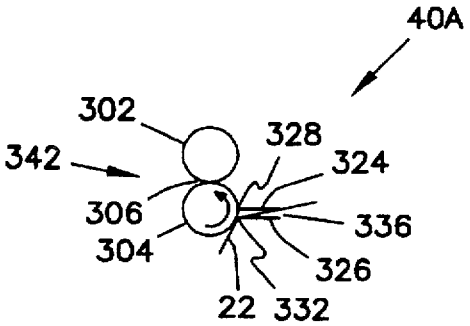
FIG. 9D is a side view of the folding mechanism of FIG. 9A in the process of scoring the form.
Figure 9E:
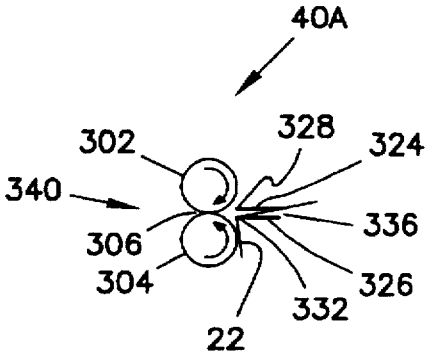
FIG. 9E is a side view of the folding mechanism of FIG. 9A with the rollers in the home position and being driven.
Figure 9F:
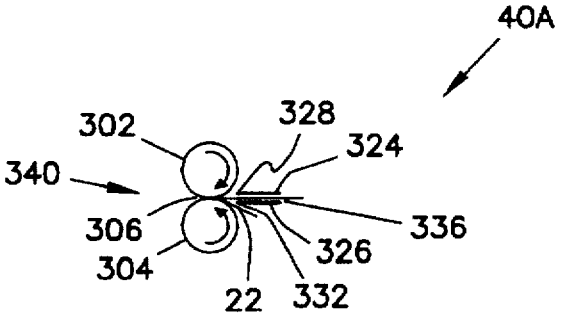
FIG. 9F is a side view of the folding mechanism of FIG. 9A with the scored form being fed into the nip of the rollers.

In making a downward fold on the form 22 the set of rollers 300 is first moved to the pre-downward fold position 342 as shown in FIG. 9B. Second, the form 22 is fed through the guide plate gap 336 so that a portion of the form 22 extends beyond the lower scoring edge 332 as shown in FIG. 9C. Third, the set of rollers 300 are moved vertically downward causing the lower roller 304 to come in rolling contact with the form 22 thereby pinching the form 22 between the lower fold roller 304 and the lower scoring edge 332. As the set of rollers 300 are moved downward, the lower fold roller 304 is driven counterclockwise at a rate that minimizes sliding as the lower fold roller 304 contacts the form 22. The rolling contact between the lower fold roller 304 and the form 22 produces a scored line on the form 22 at the location of the lower scored edge 332 as shown in FIG. 9D. Fourth, the set of fold rollers 300 stops its vertical descent when it reaches the home position 340 as shown in FIG. 9E. At this point in the folding process, the portion of the form 22 extending over the lower scoring edge 332 is tucked under the lower fold roller 304 and the scored line is aligned adjacent to the fold roller nip 306. Fifth, the upper fold roller 302 is caused to rotate in a clockwise direction and the lower fold roller 304 is caused to rotate in a counterclockwise direction as shown in FIG. 9F. Sixth, the form 22 is fed towards the rotating fold rollers 302, 304 causing the scored line of the form 22 to be drawn into the nip 306 of the rotating fold rollers 302, 304 as shown in FIG. 9F. As the scored line is rolled through the nip 306 of the rotating fold rollers 302, 304, a fold is created in the form 22 at the location of the scored line.

In making an upward fold on the form 22 that needs to be folded, the set of rollers 300 is first moved to the pre-upward fold position 344. Second, the form 22 is fed through the guide plate gap 336 so that a portion of the form 22 extends beyond the upper scoring edge 328. Third, the set of rollers 300 are moved vertically upward causing the upper roller 302 to come in rolling contact with the form 22 thereby pinching the form 22 between the upper fold roller 302 and the upper scoring edge 328. As the set of rollers 300 are moved upward, the upper fold roller 302 is driven clockwise at a rate that minimizes sliding as the upper fold roller 302 contacts the form 22. The rolling contact between the upper fold roller 302 and the form 22 produces a scored line on the form 22 at the location of the upper scored edge 228. Fourth, the set of fold rollers 300 stops its vertical ascent when it reaches the home position 340. At this point in the folding process, the portion of the form 22 extending over the upper scoring edge 228 is wrapped over the upper fold roller 302 and the scored line is aligned adjacent to the fold roller nip 306. Fifth, the upper fold roller 302 is caused to rotate in a clockwise direction and the lower fold roller 304 is caused to rotate in a counterclockwise direction. Sixth, the form 22 is fed towards the rotating fold rollers 302, 304 causing the scored line of the form 22 to be drawn into the nip 306 of the rotating fold rollers 302, 304. As the scored line is rolled through the nip 306 of the rotating fold rollers 302, 304, a fold is created in the form at the location of the scored line.

Figure 10:
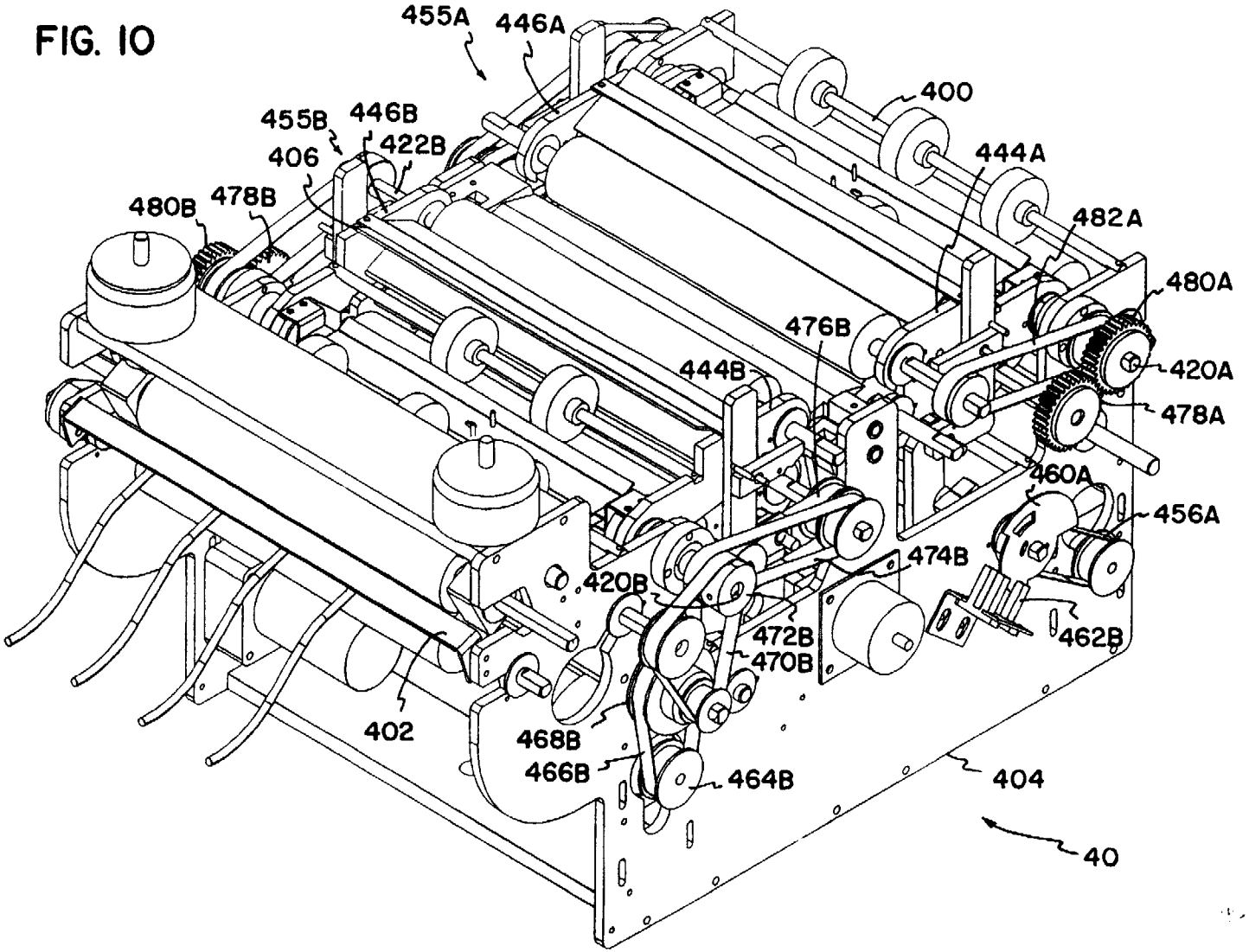
FIG. 10 is a perspective view of an embodiment of the form folding module of this invention.

Referring to FIG. 10, there is illustrated the preferred embodiment of the folding module 40 in accordance with the principles of the present invention and having an upstream end 400 connected in series with the card affixing module 30 and a downstream end 402 connected in series with the envelop stuffing module 50 or form stacker 51. The folding module 40 also has a front side 404 opposite from a back side 406. The front side 404 and the back side 406 extend from the upstream end 400 to the downstream end 402 of the folding module 40.

It will be appreciated that the folding module 40 is rotatedly adjustable about a central vertical axis (not shown). This allows the folding module 40 to be rotated relative to the affixing module 30 in order to correct the alignment between the modules 30, 40 to prevent forms 22 from being fed at an angle from the affixing module 30 to the folding module 40. This is important because if the forms 22 are skewed as they enter the folding module 40, the subsequent folds will also be skewed.

Figure 11:
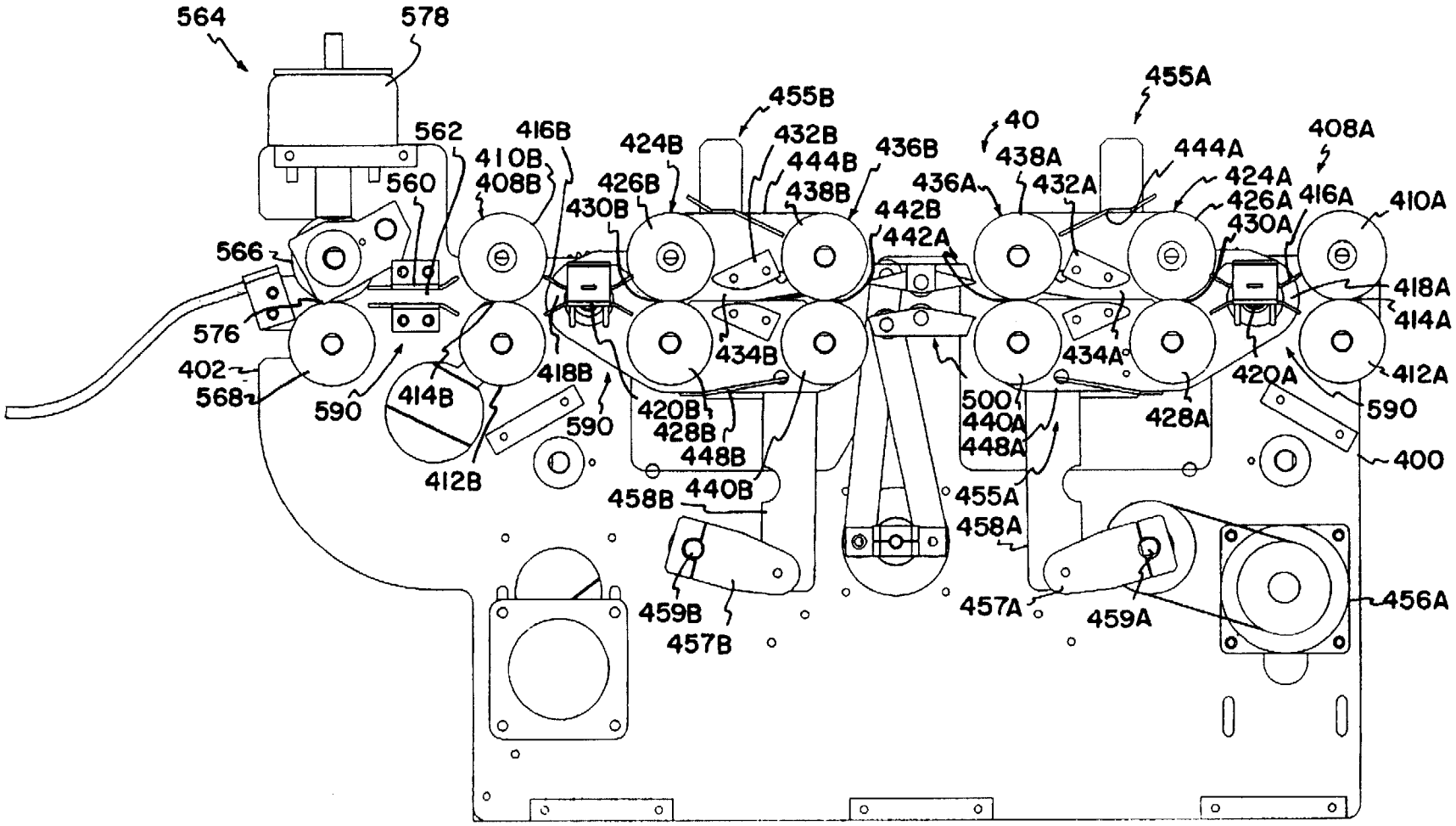
FIG. 11 is a side view of the folding module of FIG. 10 showing the rollers.
Figure 12:
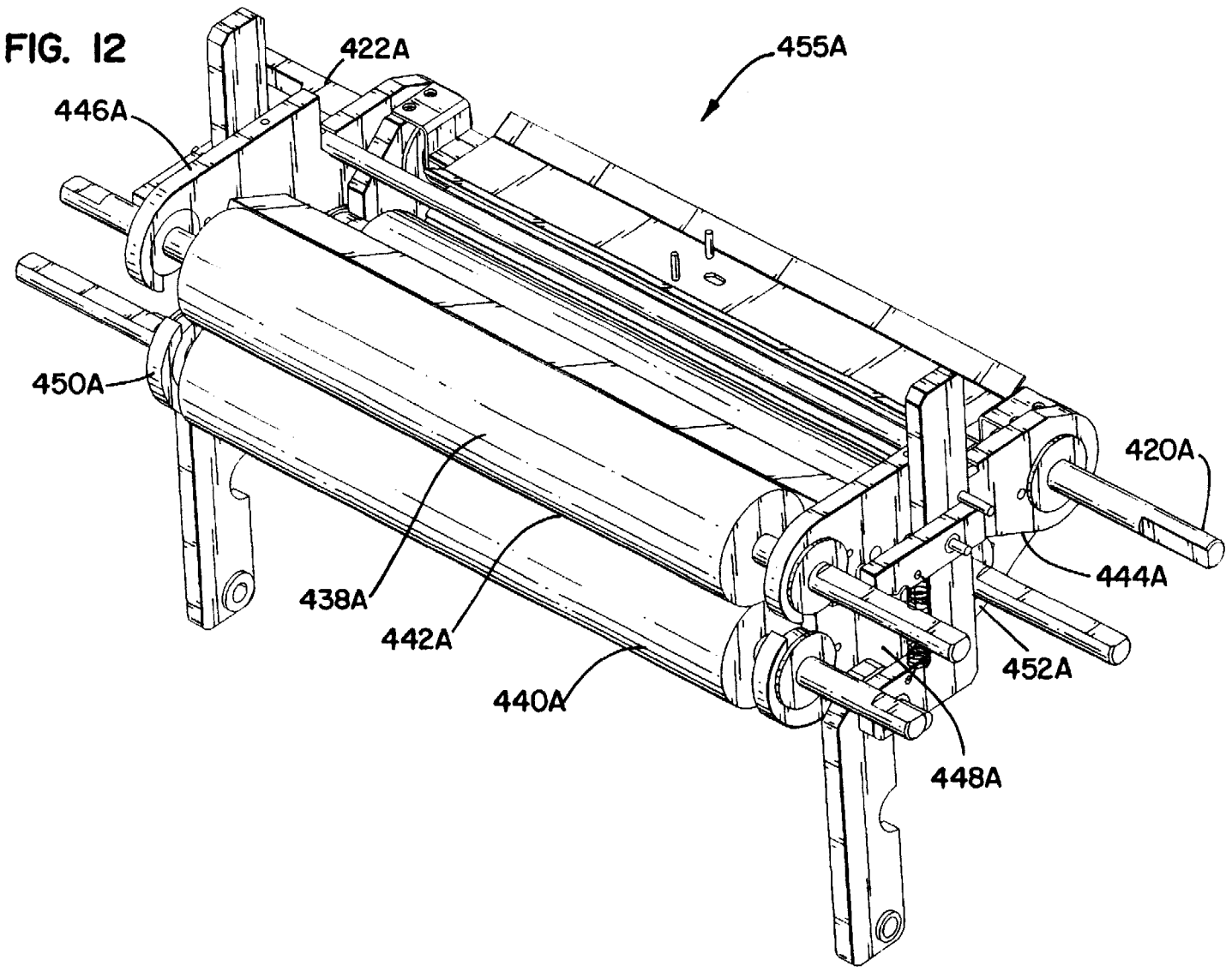
FIG. 12 is a perspective view of a roller structure as included in the folding module of FIG. 10.

Referring to FIGS. 11 and 12, positioned at the upstream end 400 of the form folding module 40 is a first form transport unit 408A. The first form transport unit 408A has an idle first upper roller 410A positioned above a driven first lower roller 412A. Both the idle first upper roller 410A and the first lower roller 412A extend from the front side 404 to the back side 406 of the form folding module 40. A first form transport nip 414A is located between the two rollers 410A and 412A.

Positioned directly downstream from the first form transport unit 408A is a first pair of form guidance brackets 416A. The form guide brackets 416A extend from the front side 404 to the back side 406 of the card folding module 40 and define a first gap 418A which is aligned with the first form transport nip 414A. Extending outward from the form guidance brackets 416A adjacent to the front side 404 of the form folding module 40 is a first pivot member 420A. Extending outward from the form guidance brackets 416A adjacent to the back side 406 of the form folding module 40 is the second pivot member 422A which is shown in FIG. 12.

Positioned immediately downstream from the first form guidance brackets 416A is the second form transport unit 424A which has a idle second upper roller 426A positioned above a driven second lower roller 428A. The second upper roller 426A and the second lower roller 428A extend from the front side 404 to the back side 406 of the form folding module 40 and have a length approximately equal to the width of the form 22 being transported. Located between the second upper roller 426A and the second lower roller 428A is a second form transport nip 430A.

Positioned immediately downstream from the second form transport unit 424A is a second pair of form guidance brackets 432A which extend from the front side 404 to the back side 406 of the form folding module 40. The second pair of form guidance brackets 432A define a second gap 434A which is aligned with the second form transport nip 430A.

Positioned immediately downstream from the second pair of form guidance brackets 432A is a third form transport unit 436A having a driven third upper roller 438A positioned above a driven third lower roller 440A. The driven third upper roller 438A and the driven third lower roller 440A extend from the front side 404 to the back side 406 of the form folding module 40 and have a length approximately equal to the width of the form 22 being transported. Located between the driven third upper roller 438A and the driven third lower roller 440A is a third form nip 442A which is aligned with the second gap 434A defined by the second pair of form guidance brackets 432A.

As best shown in FIGS. 11 and 12, the driven third upper roller 438A and the idle second upper roller 426A are rotatedly connected to a first upper frame member 444A which is positioned adjacent to the front side 404 of the form folding module 40. The first upper frame member 444A is rotatedly connected to the first pivot member 420A. The driven third upper roller 438A and the idle second upper roller 426A are also rotatedly connected to a second upper frame member 446A which is positioned adjacent to the back side 406 of the form folding module 40. The second upper frame member 446A is rotatedly connected to the second pivot member 422A. The driven third lower roller 440A and the driven second lower roller 428A are rotatedly connected to a first lower frame member 448A which is positioned below the first upper frame member 444A. The first lower frame member 448A is rotatedly connected to the first pivot member 420A. The driven third lower roller 440A and the driven second lower roller 428 are also connected to a second lower frame member 450A positioned below the second upper frame member 446A and rotatedly connected to the second pivot member 422A.

The first upper frame member 444A is connected to the first lower frame member 448A through the use of a first spring assembly 452A. The second upper frame member 446A is connected to the second lower frame member 450A through the use of a second spring assembly (not shown). Besides holding the frame members 444A, 446A, 448A, 450A together, the first spring assembly 452A and the second spring assembly (not shown) also bias the driven third upper roller 438A against the driven third lower roller 440A. By joining the frame members 444A, 446A, 448A, 450A together, the first and second spring assemblies 452A, 454A create a first roller structure 455A which is entirely rotatable about the first pivot member 420A and the second pivot member 422A as is best shown in FIG. 12.

Figure 13:
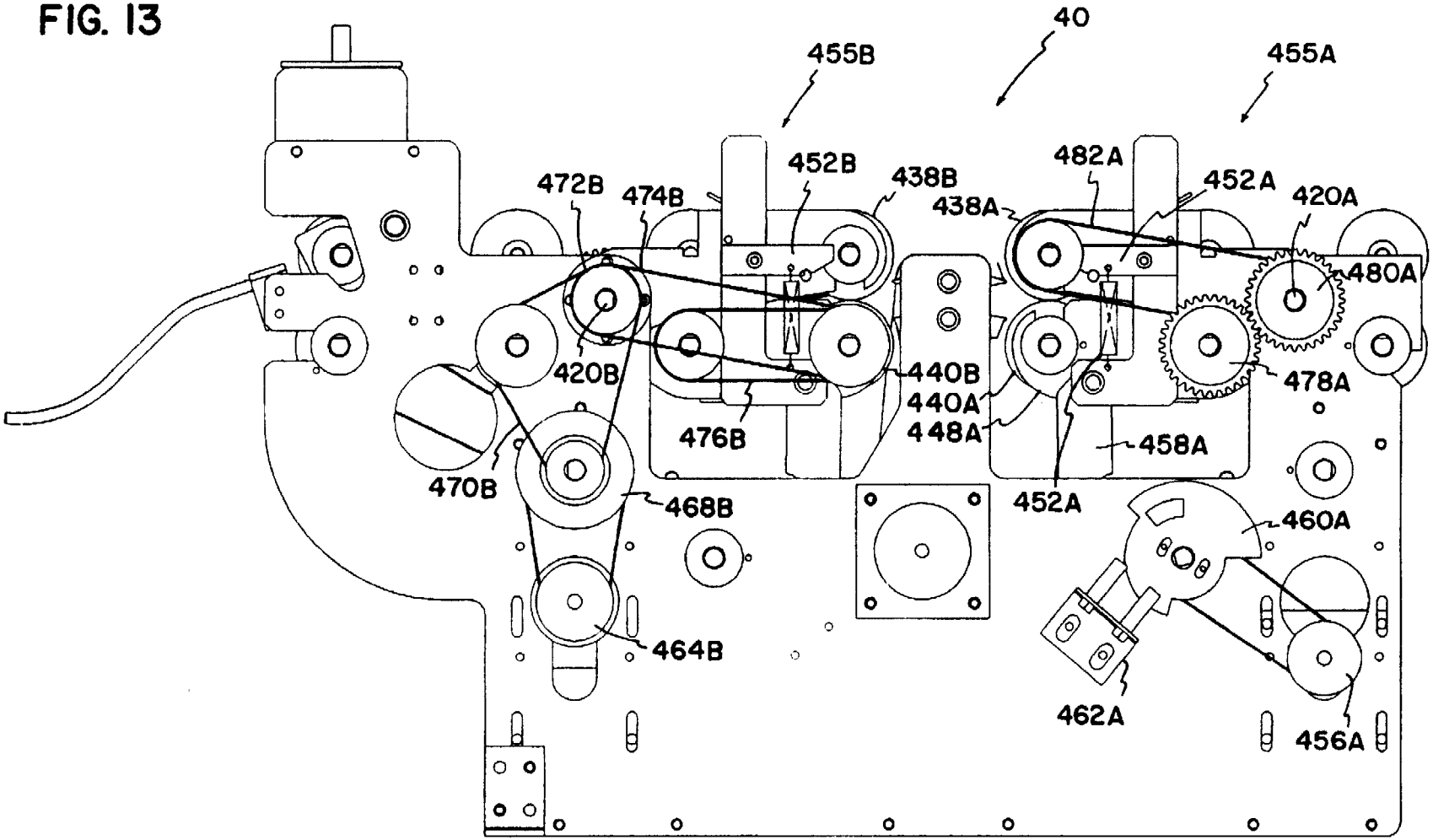
FIG. 13 is a side view of the folding module of FIG. 10 showing the drive configuration.

Referring to FIGS. 11 and 13, the first lower frame member 448A is connected to first hinged members 458A located adjacent to the back side 406 and front side 404 of the folding module 40. The first hinged members 458A are connected to first drive elements 457A that are rigidly mounted on a first drive shaft 459A. The first drive shaft 459A is driven by a first gear motor 456A that rotates the shaft 459A in first and second directions. The first gear motor 456A generally does not rotate the first drive shaft 459A more than 90 degrees in any one direction before changing directions. As the shaft 459A rotates in the first direction, the first drive elements 457A pull the first hinged members 458A and the connected first roller structure 455A downward. In contrast, as the shaft 459A rotates in the second direction, the first drive elements 457A push the first hinged members 458A and the connected first roller structure 455A upward. In this way, the entire first roller structure 455A is caused to repeatedly rotate in first and second directions about the first and second pivot members 420A and 422A.

Referring to FIG. 13, rotatedly mounted on the first drive shaft 459A is a first flag 460A which works in combination with a first gear motor photocell 462A and the folding module local processor (not shown) to control and monitor the position of the first roller structure 455A.

Referring again to FIG. 11, positioned downstream from the first roller structure 455A is a second roller structure 455B which is configured in the mirror image of the first roller structure 455A. The second roller structure 455B has a third upper frame member 444B and a third lower frame member 448B which are rotatedly connected to a third pivot member 420B and are biased together by a third spring assembly 452B. The second roller structure 455B also has a fourth upper frame member 446B and a fourth lower frame member (not shown) which are rotatedly connected to a fourth pivot member 422B and are biased together by a fourth spring assembly (not shown).

As best shown in FIG. 11, rotatedly mounted between the third upper, third lower, fourth upper and fourth lower frame members 444B, 448B, 446B, (not shown), is a fourth form transport unit 436B having a driven fourth upper roller 438B, a driven fourth lower roller 440B and a fourth form nip 442B. Located immediately downstream from the fourth form transport unit 436B is a third pair of guidance brackets 432B which define a third gap 434B. Positioned immediately downstream from the third pair of form guidance brackets 432B is a fifth form transport unit 424B having an idle fifth upper roller 426B, a driven fifth lower roller 428B and a fifth form nip 430B.

Positioned immediately downstream from the fifth form transport unit 424B is a fourth pair of form guidance brackets 416B to which the third pivot member 420B and the fourth pivot member 422B are connected. The fourth pair of form guidance brackets 416B define a fourth gap 418B.

Positioned immediately downstream from the fourth pair of form guidance brackets 416B is a sixth form transport unit 408B having an idle sixth upper roller 410B, a driven sixth lower roller 412B and a sixth form nip 414B.

The second roller structure 455B is rotated about the third pivot member 420B and the fourth pivot member 422B by second hinged members 458B connected to second drive elements 457B that are rigidly mounted on a second drive shaft 459B. The drive shaft 459B is rotated by a second gear motor (not shown) located adjacent to the back side 406 of the folding module 40. The second gear motor (not shown) moves the second roller structure 455B in the same manner as the first gear motor 456A moves the first roller structure 455A.

It will be appreciated that rollers 412A, 428A, 438A and 440A and rollers 412B, 428B, 438B and 440B are driven by two separate systems of motors, belts, sheaves and gears that are configured in the mirror image of each other. It will also be appreciated that although the back side 406 of the folding module is not shown, the structure of parts not shown can be understood by viewing the structure of the representative mirrored part located at the front side 404.

Referring to FIGS. 10 and 13, the sixth lower roller 412B, the fifth lower roller 428B, the fourth lower roller 440B, and the fourth upper roller 438B are all driven by a first roller drive motor 464B. Similarly, the first lower roller 412A, the second lower roller 428A, the third lower roller 440A, and the third upper roller 438A are all driven by a second roller drive motor (not shown) positioned adjacent to the back side 406 of the folding module 40. Belt 466B located adjacent to the front side 404 of the form folding module 40 connects the second roller drive motor 464B to conversion pulley 468B for providing the proper gear ratio conversion. Belt 470B positioned adjacent to the front side 404 of the form folding module 40 connects conversion pulley 468B to the sixth lower roller 412B and transfer sheave 472B which is mounted on the third pivot member 420B. Belt 474B located adjacent to the front side 404 of the form folding module 40 connects transfer sheave 472B to the fourth lower roller 440B. Belt 476B positioned adjacent to the front side 404 of the form folding module 40 connects a fourth lower roller 440B to the fifth lower roller 428B. The first second and third lower rollers 412A, 428A, 440A are driven by a similar pulley, belt and sheave configuration adjacent to the back side 406 and arranged in the mirror image.

Transfer gear 478A mounted on the second lower roller 428A adjacent to the front side 404 of the form folding module 40 transfers torque to geared transfer sheave 480A which is rotatedly mounted on the first pivot member 420A. Belt 482A located adjacent to the front side 404 of the form folding module 40 connects the first geared transfer sheave 480A to the third upper roller 438A. The use of the first transfer gear 478A and the first geared transfer sheave 480A reverses the rotating of the third upper roller 438A relative to the third lower roller 440A. The fourth upper roller 438B is driven by a similar gear, transfer sheave and belt configuration adjacent to the back side 406 and arranged in the mirror image.

Figure 14:
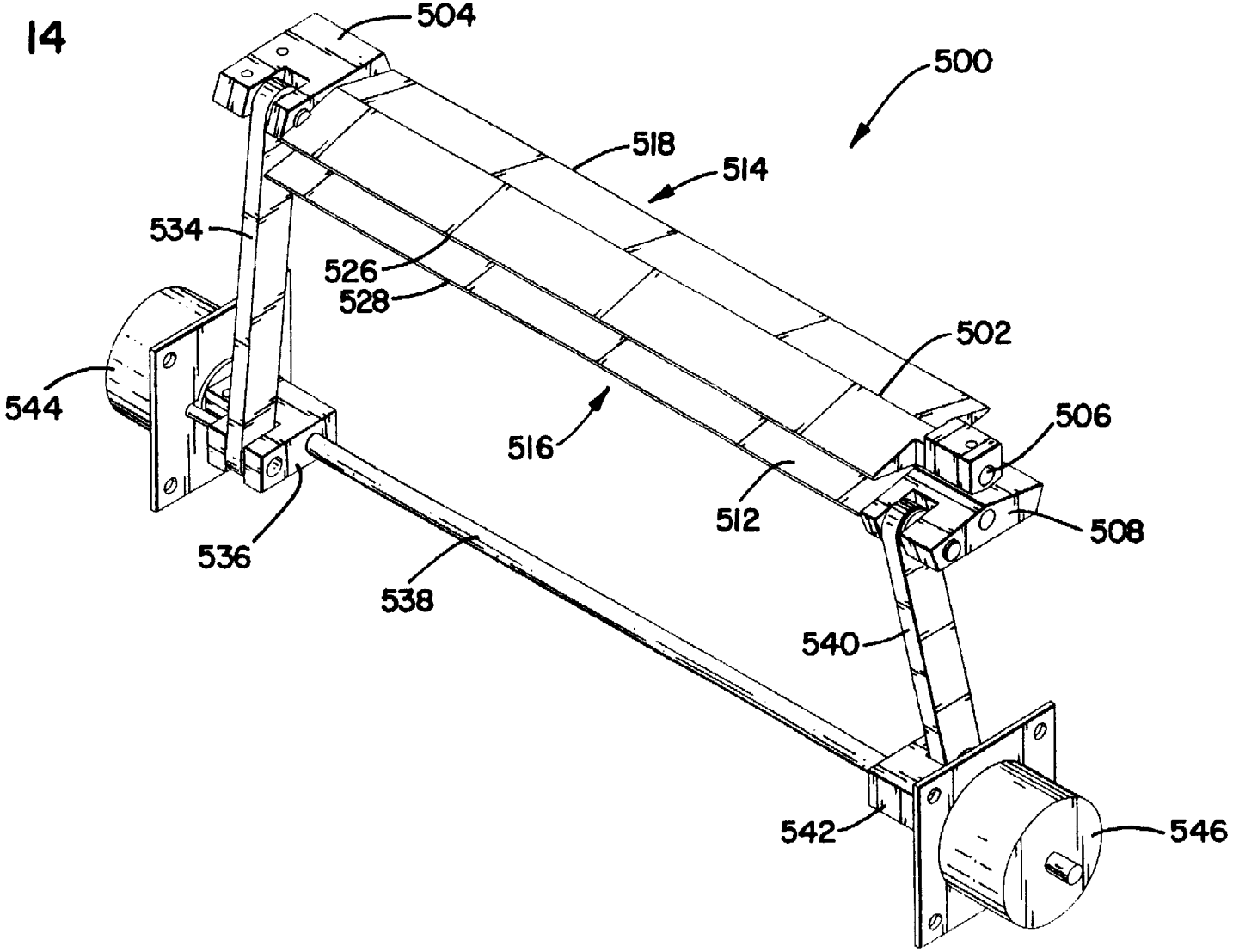
FIG. 14 is an enlarged perspective view of the form nipping mechanism of the folding module of FIG. 10.
Figure 15:
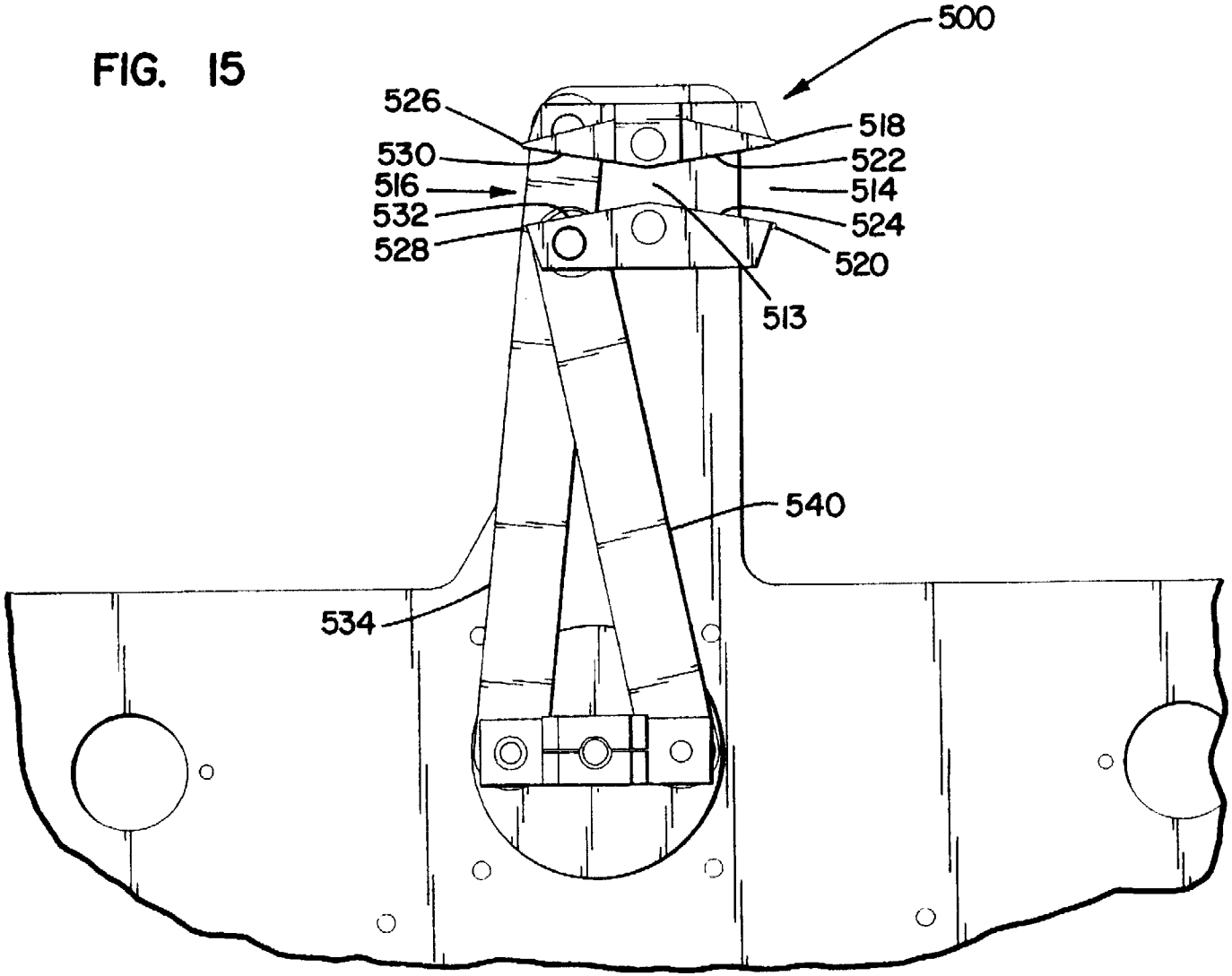
FIG. 15 is a side view of the form nipping mechanism of FIG. 14.

Positioned between the third form transport unit 436A and the fourth form transport unit 436B is a form nipping mechanism 500. As best shown in FIGS. 14 and 15, the form nipping mechanism 500 has a parallelogram shaped upper member 502 which extends from the front side 404 to the backside 406 of the form folding module 40. The upper member 502 has a centrally pivoted first nipper bracket 504 located adjacent to the backside 406 of the form folding module 40 and a first pivot point 506 located adjacent to the front side 404 of the form folding module 40. Positioned below the parallelogram shaped upper member 502 is a parallelogram shaped lower member 512 having a centrally pivoted second nipper bracket 508 located below the first pivot point 506 and a second pivot point (not shown) located below the first nipper bracket 504. The upper member 502 and the lower member 512 define a nipper form guidance gap 513 located between the two opposing members 502, 512.

The parallelogram shaped upper member 502 and the parallelogram shaped lower member 512 cooperate to form a first pinching unit 514 located upstream from a second pinching unit 516. The first pinching unit 514 has a first upper scoring edge 518 positioned above a first lower scoring edge 520 and a first upper pinching surface 522 positioned above a first lower pinching surface 524. Similarly, the second pinching unit 516 has a second upper scoring edge 526 aligned above a second lower scoring edge 528 and a second upper pinching surface 530 aligned above a second lower pinching surface 532.

The centrally pivoted first nipper bracket 504 is rotatedly connected to a first double-hinged nipper link 534 which is rotatedly connected to a first actuator bracket 536. The first actuator bracket 536 is rigidly connected to a nipper power shaft 538 which extends from the back side 406 to the front side 404 of the form folding module 40. The centrally pivoted second nipper bracket 508 is rotatedly connected to a second double-hinged nipper link 540 which is rotatedly connected to a second actuator bracket 542. The second actuator bracket 542 is rigidly connected to the nipper power shaft 538 and is aligned 180 degrees out of phase with the first actuator bracket 536.

A first rotary actuator 544 is connected to the nipper power shaft 538 adjacent to the backside 406 of the form folding module 40. A second rotary actuator 546 is connected to the nipper power shaft 538 adjacent to the front side 404 of the form folding module 40. When the first rotary actuator 544 is energized, it rotates the nipper power shaft 538 in a first direction. When the second rotary actuator 546 is energized, it rotates the nipper power shaft 538 in a second direction.

In operation, the first rotary actuator 544 and the second rotary actuator 546 work together to alternately open and close the first pinching unit 514 and the second pinching unit 516. When the first rotary actuator 544 is energized, the second rotary actuator 546 is de-energized. This allows the first rotary actuator 544 to rotate the nipper power shaft 538 in a first direction which cause the second upper scoring edge 526 of the second pinching unit 516 to be pushed upward while the second lower scoring edge 528 is pulled downward thereby opening the second pinching unit 516 and closing the first pinching unit 514. In contrast, when the second rotary actuator 546 is energized, the first rotary actuator 544 is de-energized thereby allowing the second rotary actuator 546 to rotate the nipper power shaft 538 in a second direction. As the nipper power shaft 538 is rotated in a second direction, the second upper scoring edge 526 is pulled downward while the second lower scoring edge 528 is pushed upward, thereby closing the second pinching unit 516 and opening the first pinching unit 514.

It will be appreciated that the two one-directional actuators 544, 546 can be replaced with a single bi-directional rotary actuator.

The first roller structure 455A and the second roller structure 455B can be moved upward or downward relative to the form nipping mechanism 500. As described previously, the upward and downward motion of the first roller structure 455A and the second roller structure 455B is controlled by the first gear motor 456A and the second gear motor (not shown) which are controlled by the folding module local module processor (not shown). Through motor control commands from folding module local module processor to the first gear motor 456A and the second gear motor (not shown), the roller structures 455A, 455B can be individually aligned in one of three positions as best shown in FIGS. 18A–18F. The first position is the home position 550 in which the roller structures 455A, 455B are aligned adjacent to the form guidance gap 513 of the form nipping mechanism 500. The second position is the pre-downward fold position 552, in which the roller structures 455A, 455B are rotated above the form nipping mechanism 500. The third position is the pre-upward fold position 554 in which the roller structures 455A, 455B are rotated below the form nipping mechanism 500.

Referring to FIG. 11, Located directly downstream from the sixth form transport unit 408B is a fifth pair of form guidance brackets 560 which define a fifth form guidance gap 562.

Figure 16:
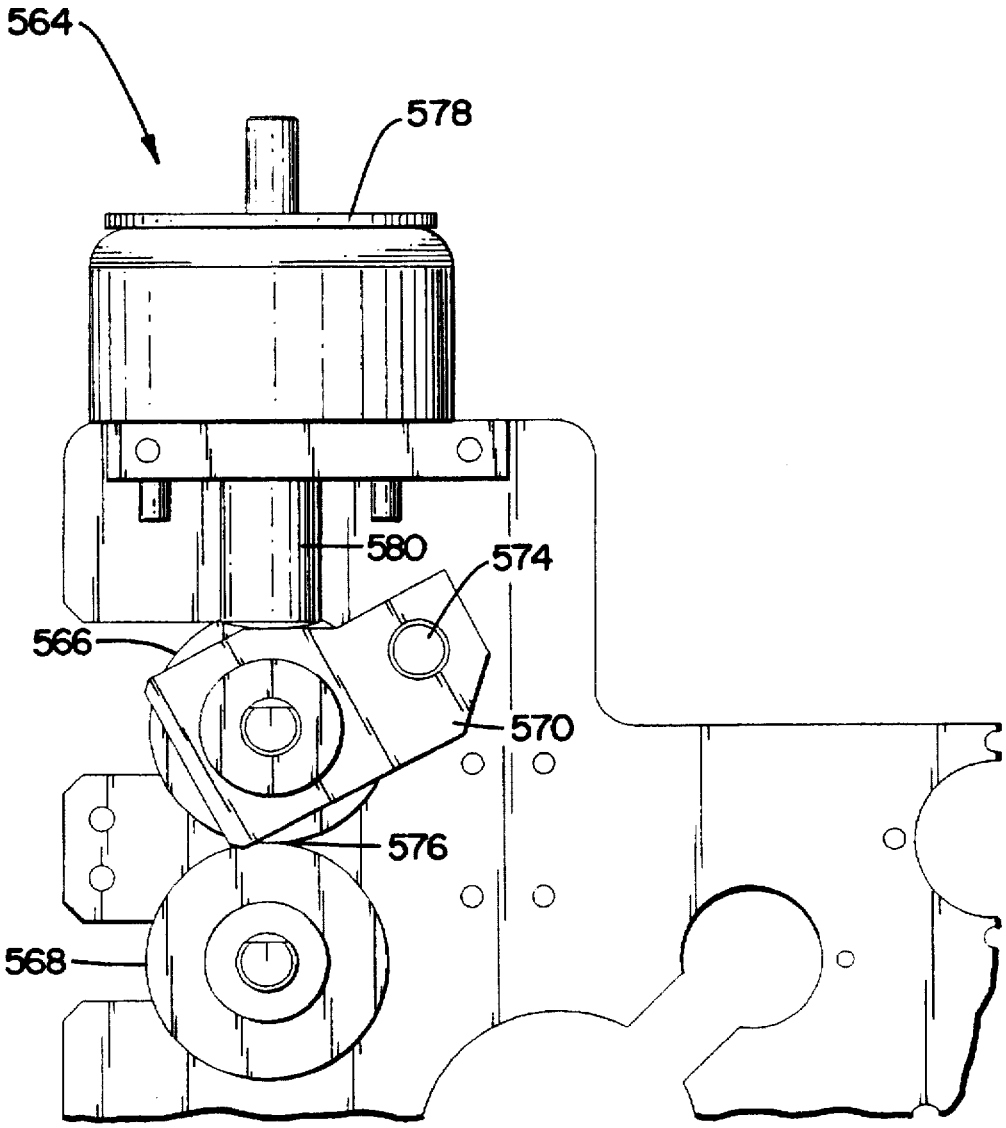
FIG. 16 is a enlarged side view of the form creasing mechanism shown in FIG. 10.
Figure 17:
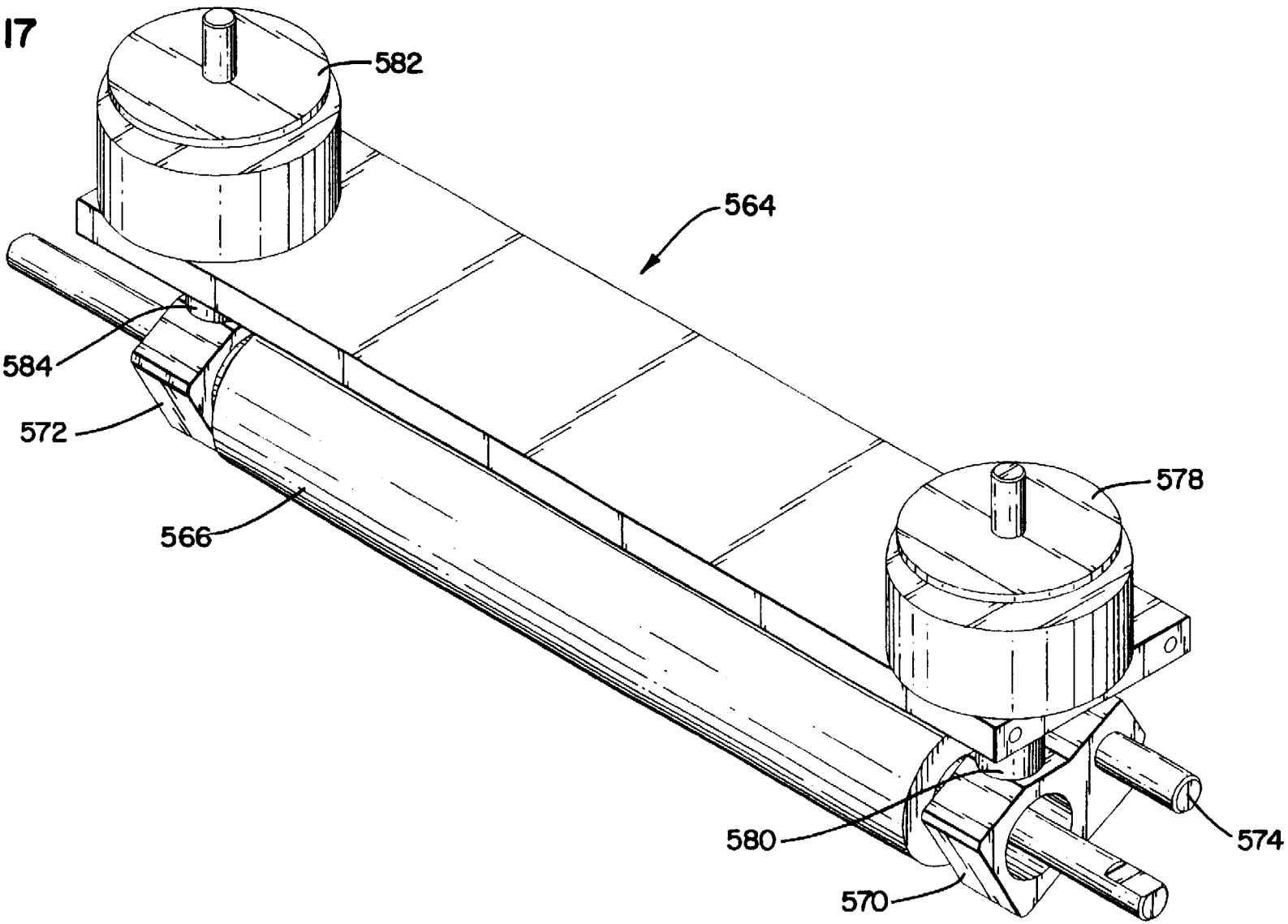
FIG. 17 is a perspective view of the form creasing mechanism of FIG. 16.

Positioned immediately downstream from the fifth pair of form guidance brackets 560 is a form creasing unit 564. Referring to FIGS. 16 and 17, the form creasing unit 564 has an upper crease roller 566 positioned above a lower crease roller 568 which extend from the front side 404 to the back side 406 of the form folding module 40. The upper crease roller 566 is rotatedly mounted on a first creased roller pivot arm 570 located adjacent to the front side 404 of the form folding module 40 and a second crease roller pivot arm 572 located adjacent to the back side 406 of the form folding module 40. The crease roller pivot arms 570, 572 are rotatedly connected to a creasing unit pivot shaft 574 which is aligned above and generally parallel to the upper crease roller 566. A form creasing nip 576 is located between the upper crease roller 566 and the lower crease roller 568.

Positioned above the first creased roller pivot arm 570 is a first crease solenoid 578 having a first crease plunger 580 which is vertically aligned directly above the first crease roller pivot arm 570. Positioned above the second crease roller pivot arm 572 is a second crease solenoid 582 having a second crease plunger 584 which is vertically aligned directly above the second crease roller pivot arm 572.

When the crease solenoids 578, 582 are energized, the crease plungers 580, 584 are forced downward against the crease roller pivot arms 570, 572. As the downward force is applied to the crease roller pivot arms 570, 572, they pivot downward about the creasing unit pivot shaft 574 thereby transferring force to the upper crease roller 566. This causes the upper crease roller 566 to be pushed firmly against the lower crease roller 568 thereby creating localized pressure along the form creasing nip 576.

As shown in FIG. 11, form folding photocells 590 are positioned adjacent to the first form guidance gap 418A, the fourth form guidance gap 418B and the fifth form guidance gap 562. The form folding photocells 590 detect the leading and trailing edges of the form 22 that is being transported through the form folding module 40 and send machine control data to the form folding module local module processor (not shown). The folding module local module processor interprets the machine control data and generates machine control commands which are sent to the first roller drive motor (not shown) and the second roller drive motor 464B which mechanically implement the commands. By computer controlling first drive motor (not shown) and the second drive motor 464B the exact location of the form being transported through the form folding mechanism can be precisely controlled at all times.

In order to better disclose a preferred embodiment of this invention, it is necessary to describe the form folding module 40 in operation. In this regard, the following is a description of how the form folding module 40 of the preferred embodiment completes a C-fold on the form 20.

The form 22 carrying affixed cards 34 is transferred from the card affixing module 30 to the first form transport unit 408A. The form 22 is then fed through the first form transport nip 414A into the first form guidance gap 418A of the first pair of form guidance brackets 416A.

From the first form guidance gap 418A, the form 22 is fed into the second form transport unit 424A which propels the form through the second form guidance gap 434A. Next, the form 22 is fed through the third form transport unit 436A. At this point in time, the first roller structure 455A is in the home position 550 and the second roller structure 455B is in the pre-upward fold position 554. Also at this point in time, the form nipping mechanism 500 is de-energized leaving the parallelogram shaped upper member 502 and the parallelogram shaped lower member 512 to float freely with the first pinching unit 514 and the second pinching unit 516 being partially open.

Figure 18A:
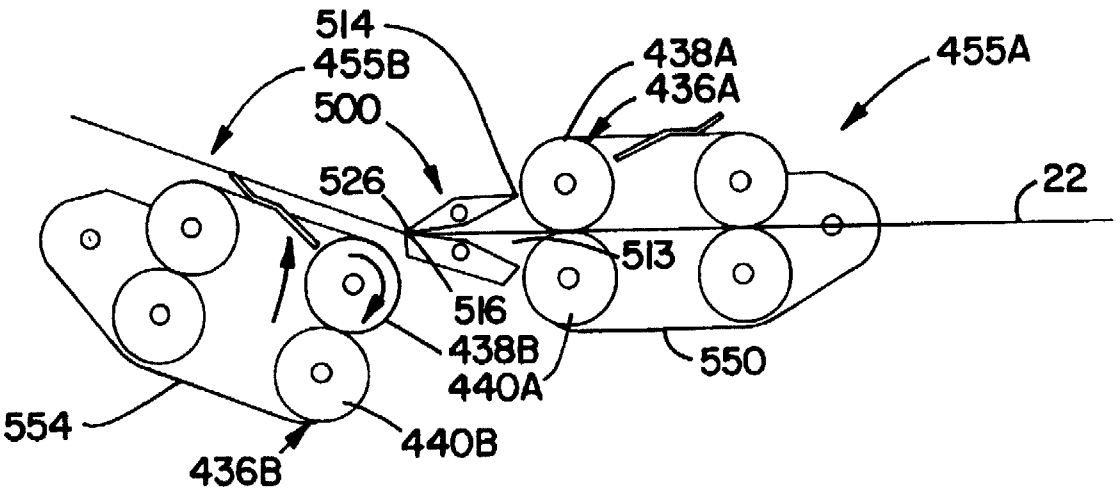
FIGS. 18A–18F are side views of the roller assemblies of FIG. 10 showing the various stages of the folding process.

Next, the form 22 is guided by the first pinching unit 514 through the nipper form guidance gap 513. The form 22 is fed downstream by the third form transport unit 436A until one-third of the form 22 extends beyond the second upper scoring edge 526 of the second pinching unit 516. At this moment, the third form transport unit 436A stops the downstream movement of the form 22 and the second pinching unit 516 is caused to clamp down upon the form 22 as shown in FIG. 18A.

Figure 18B:
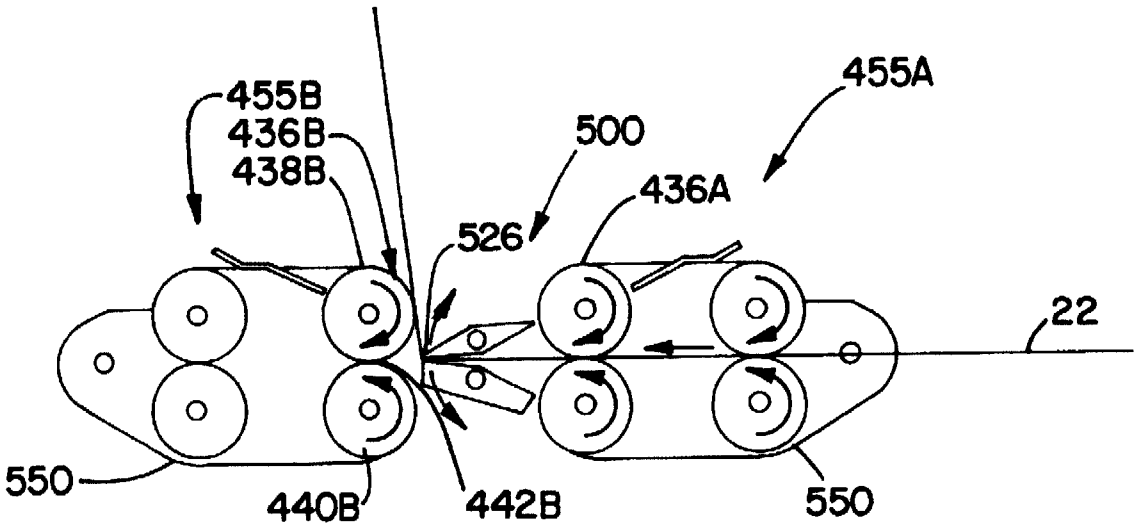

In the next step, the second roller structure 455B is caused to rotate upward from the pre-upward fold position 554 towards the home position 550. As the second roller structure 455B moves upward, it causes the fourth upper roller 438B to come in rolling contact with the form 22 thereby pinching the form 22 between the fourth upper roller 438B and the second upper scoring edge 526. When the fourth upper roller 438B is moved upward, it is simultaneously rotated clockwise in order to prevent the roller 438B from sliding as it contacts the form 22. The rolling contact between the fourth upper roller 438B and the form 22 produces a first scored line on the form 22 at the location of the second upper scoring edge 526. When the second roller structure 455B reaches the home position 550, it stops its vertical ascent. At this point in time, the third of the form 22 which is extending over the second upper scoring edge 526 is wrapped over the fourth upper fold roller 438B and the scored line is aligned adjacent the fourth form nip 442B as shown in FIG. 18B.

Figure 18C:
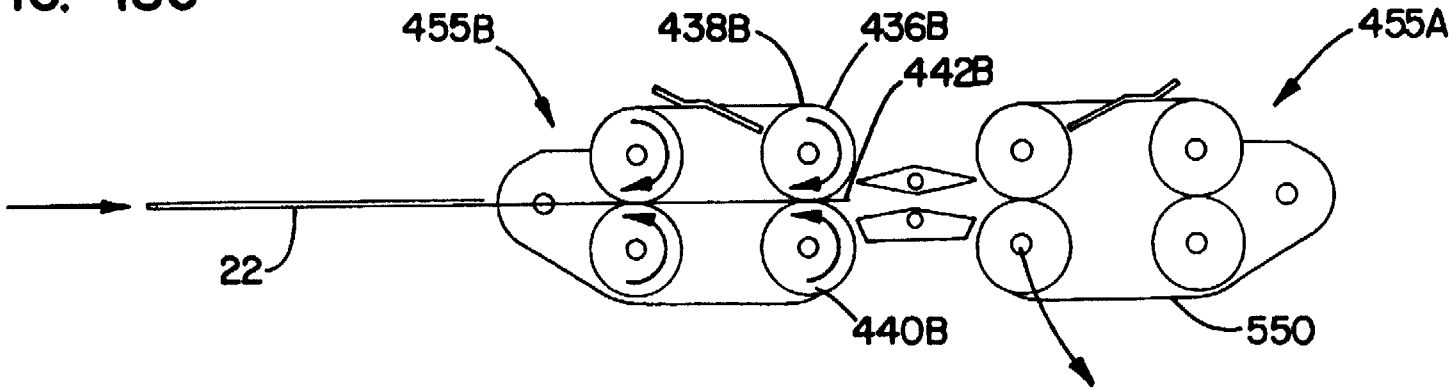

Next, the fourth upper roller 438B and the fourth lower roller 440B are caused to rotate while the second pinching unit 516 opens and the third form transport unit 436A begins to feed the form 22 towards the rotating fourth upper and lower rollers 438B, 440B. This causes the scored line of the form 22 to be drawn into the fourth form nip 442B of the rotating fourth upper and lower rollers 438B, 440B thereby creating a fold in the form 22 at the location of the first scored line as shown in FIG. 18C.

The fourth form transport unit 436B continues to feed the folded form downstream until the trailing edge of the form passes the upper scoring edge 518 of the first pinching unit 514. Once the trailing edge of the form passes the upper scoring edge 518, the first roller structure 455A is caused to rotate downward from the home position 550 to the pre-upward fold position 554.

Figure 18D:
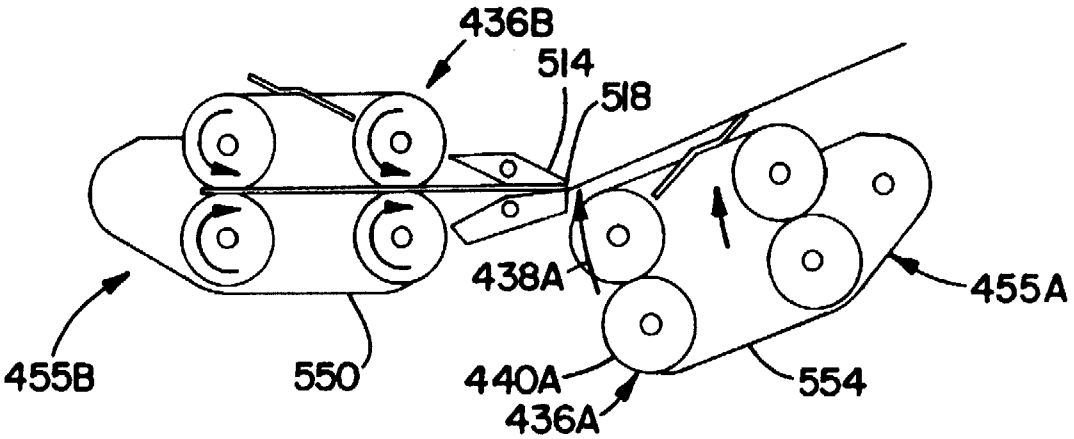

Next, the fourth form transport unit 436B feeds the folded form upstream until one-third of the form extends beyond the first upper scoring edge 518 of the first pinching unit 514. When one-third of the folded form 22 extends beyond the first upper scoring edge 518, the fourth form transport unit 436B stops the upstream movement of the form 22 and the first pinching unit 514 clamps down upon the form 22. The first roller structure 455A is then caused to rotate up from the pre-upward fold 554 position towards the home position 550 as shown in FIG. 18D. As the first roller structure 455A rotates upward, the third upper roller 438A comes in rolling contact with the form 22 thereby pinching the form 22 between the third upper roller 438A and the first upper scoring edge 518. When the third upper roller 438A is moved upward, it is simultaneously rotated counterclockwise in order to prevent the roller 438A from sliding as it contacts the form 22. The rolling contact between the third upper roller 438A and the form 22 produces a second scored line on the form 22 at the location of the first upper scoring edge 518 of the first pinching unit 514. When the first roller structure 455A reaches the home position 550, it stops its vertical ascent.

Figure 18E:
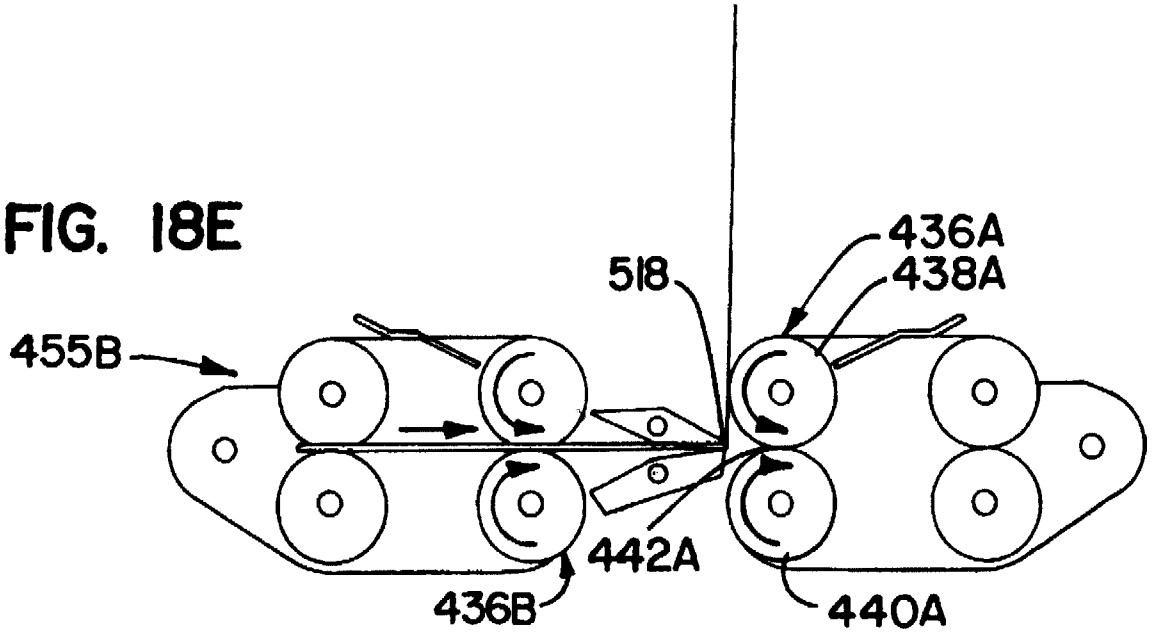
Figure 18F:
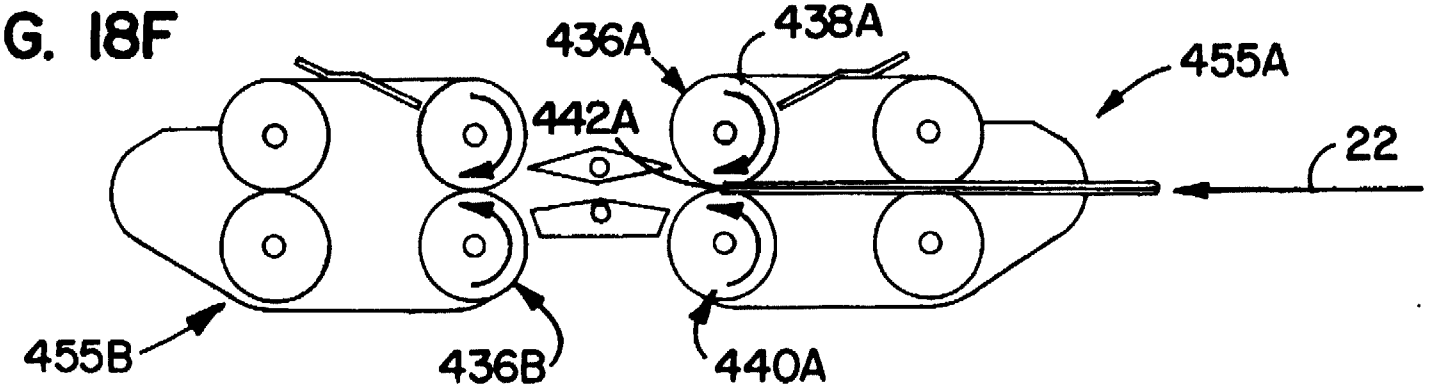

At this point in the folding sequence, the third of the form 22 which is extending past the first upper scoring edge 518 is wrapped over the third upper roller 438A and the second scored line is adjacent to the third form nip 442A of the third form transport unit 436A as shown in FIG. 18E. As a next step in the folding sequence, the third upper and lower rollers 438A, 440A are caused to rotate while the first pinching unit 514 is opened and the fourth form transport unit 436B resumes feeding the form 22 upstream. This causes the second scored line on the form 22 to be drawn into the third form nip 442A of the third form transport unit 436A. As the second scored line is rolled through the third form nip 442A of the rotating third upper and lower rollers 438A, 440A, a fold is created in the form at the location of the second scored line as shown in FIG. 18F.

Once the fold is created at the second scored line by the rotating third upper and lower rollers 438A, 440A, the rollers 438A, 440A reverse direction and feed the double folded form downstream through the nipper mechanism form guidance gap 513 and into the fourth form transport unit 436B. The fourth form transport unit 436B transfers the double folded form 22 through the third pair of form guidance brackets 432B and into the fifth form transport unit 424B. The fifth form transport unit 424B feeds the form through the fourth pair of form guidance brackets 416B and into the sixth form transport unit 408B. The sixth form transport unit 408B feeds the form through the fifth pair of form guidance brackets 560 and into the form creasing unit 564.

When the first fold of the double folded form 22 enters the form creasing nip 576 located between the upper crease roller 566 and the lower crease roller 568, the crease solenoids 578, 582 are energized thereby pushing the upper crease roller 566 against the lower crease roller 568. As the first fold of the form 22 is pinched between the upper crease roller 566 and the lower crease roller 568, a tight crease is created at the location of the first fold.

Once a tight crease is created at the location of the first fold, the crease solenoids 578, 582 are de-energized as the double folded form 22 continues to move downstream. When the second fold of the double folded form 22 enters the form creasing nip 576 located between the upper crease roller 566 and the lower crease roller 568, the crease solenoids 578, 582 are again energized thereby forcing the upper crease roller 566 against the lower crease roller 568. As the second fold of the double folded form 22 is pinched between the upper crease roller 566 and the lower crease roller 568, a tight crease is formed at the location of the second fold. Once a tight crease is formed at the location of the second fold, the crease solenoids 578, 582 are again de-energized as the double folded form 22 continues to move downstream towards the envelop stuffing module 50 or the form stacker 51.

It will be appreciated that while in the embodiment shown a paper nipping mechanism 500 is used to score the form 22, in alternate embodiments, different structures having scoring edges might be substituted for the paper nipping mechanism 500. Additionally, the first pinching unit 514 and the second pinching unit 516 do not need to be completely closed in order to create an adequate scoring line to allow the form 22 to be folded. However, when the first pinching unit 514 or the second pinching unit 516 are closed during the scoring process, the scoring line is more precisely located than when the first pinching unit 514 or the second pinching unit 516 are partially open during the scoring process. Furthermore, in alternate embodiments it is possible that pinching units 514, 516 could be aligned in series progressively downstream positioned between multiple sets of roller structures 455A, 455B. Such an alternative embodiment would greatly increase the speed of the folding module 40 when multiple folds are needed by allowing the forms 22 to be continuously fed downstream as they are folded rather than reversing direction between downstream and upstream.

In order for the form folding module 40 to perform a V-fold, one half of the form 22 is fed past the second pinching unit 516 and the second roller structure 455B makes either an upward or a downward fold. In order for the form folding module 40 to perform a Z-fold, the form 22 is again folded in thirds similar to the C-fold. However, for the folding module 40 to make one type of Z-fold, the first roller structure 455A must make an upward fold and the second roller structure 455B must make a downward fold. The type of fold performed by the folding module 40 can be controlled by the folding module local module processor (not shown) by processing data supplied by the central processor 36 without making any mechanical adjustments to the folding module 40.

It is be understood that even though numerous characteristics and advantages of the invention have been set forth in the foregoing description, together with details of the structure and function of the invention, the disclosure is illustrative only, and changes may be made in detail, especially in matters of shape, size and arrangement of the parts within the principles of the invention to the full extent indicated by the broad general meaning of the terms in which the appended claims are expressed.

What is claimed is as follows:

1. A system for mailing a form with a personalized card attached thereto, the system comprising:

a) a printer module for printing text on the form;

b) a card affixing module for receiving the form from the printer module, the card affixing module being constructed and arranged to provide relative movement between the card and the form in at least two dimensions such that the card can be affixed at any location on the form;

c) a sticker module for supplying the card affixing module with the card, the card having an affixing means attached thereto; and d) a folding module for receiving the form from the affixing module, the folding module being constructed and arranged to fold the form with the card remaining attached, the folding module including:

a form guide structure having at least one edge;

a form transfer mechanism for feeding the form past the edge;

a first roller unit having a first roller aligned adjacent to a second roller, the first and second rollers being aligned substantially parallel to the edge, the first and second rollers defining a folding nip located between the first and second rollers;

a roller translating mechanism for translating the first roller unit between a first position in which the roller unit is distally located from the edge and a second position in which the folding nip of the roller unit is substantially aligned with the edge, the first roller passing in close proximity to the edge as the roller unit is moved between the first and second positions such that the form is pinched between the first roller and the edge to generate a pre-fold line on the form; and a roller rotating mechanism for rotating the first and second rollers when the roller unit is in the second position, wherein a fold is created at the pre-fold line by feeding the pre-fold line into the folding nip of the rotating first and second rollers.

2. The system of claim 1, wherein the folding module is pivotally adjustable relative to the affixing module for preventing the form from being skewed as it is fed from the affixing module to the folding module.

3. The system of claim 1, wherein the form guide structure comprises a first pinching unit having a hinged first nipping member which opposes and cooperates with a hinged second nipping member.

4. The system of claim 3, wherein the first pinching unit is connected to a actuating source for causing the first nipping member and the second nipping member to clamp down on the form while the form is being per-folded.

5. The system of claim 4, wherein a plurality of the pinching units are aligned in series, the pinching units being positioned between a plurality of the first roller units.

6. The system of claim 3, wherein the first pinching unit is integrally connected to a second pinching unit, the second pinching unit and the first pinching unit being symmetrical about common hinges.

7. The system of claim 6, wherein the first pinching unit and the second pinching unit are connected to a rotary actuator for alternately opening and closing the first and second pinching units.

8. The system of claim 1, further comprising a form creasing mechanism for receiving the form from the first roller unit and creasing the fold.

9. The system of claim 1, further comprising an envelope stuffing module for receiving the form from the folding module, the envelope stuffing module being configured to place the form in an envelope.

10. A system for mailing a form with a personalized card attached thereto, the system comprising:

a) a printer module for printing text on the form;

b) a sticker module for supplying the card with an affixing means attached thereto;

c) a card affixing module for receiving the form from the printer module and the card from the sticker module, the card affixing module being constructed and arranged to provide relative movement between the card and the form in at least two dimensions such that the card can be affixed at any location on the form, the card affixing module including:

a form transporting mechanism having a length, a width, an upstream end, and a downstream end, wherein the form transporting mechanism receives the form from the printer module at the upstream end and moves the form along the length of the form transport mechanism toward the downstream end;

a carriage operatively connected to the form transporting mechanism, the carriage being constructed and arranged to receive the card from the sticker module and hold the card;

a carriage translating mechanism for translating the carriage across the width of the form transporting mechanism; and a card pressing mechanism constructed and arranged for pressing the card held by the carriage against the form to cause the card affixing means to affix the card to the form; and d) a folding module for receiving the form from the affixing module, the folding module being constructed and arranged to fold the form with the card remaining attached.

11. The system of claim 10, wherein the affixing means comprises a pressure sensitive adhesive attached to the card.

12. The system of claim 10, wherein the carriage translating mechanism comprises a lead screw connected to the carriage, the lead screw extending across the width of the form transporting mechanism and being rotated by a drive source.

13. The system of claim 12, wherein the lead screw is connected to the carriage by a lead screw nut attached to the carriage, the lead screw nut being threadingly mounted on the lead screw, wherein when the lead screw is rotated within the lead screw nut, the lead screw nut and the connected carriage are caused to translate axially along the lead screw.

14. The system of claim 12, wherein the carriage is connected to a carriage rotation mechanism, the carriage rotation mechanism rotating the carriage about the lead screw from a home position to a card affixing position.

15. The system of claim 10, wherein the pressing mechanism includes at least one pressing roller for rolling across the card to press the card against the form and cause the affixing means to affix the card to the form.

16. The system of claim 15, wherein the pressing roller is pressed against the card by a solenoid mechanism connected to the carriage.

17. The system of claim 10, further comprising an envelope stuffing module for receiving the form from the folding module, the envelope stuffing module being configured to place the form in an envelope.

18. The system of claim 10, wherein the folding module is pivotally adjustable relative to the affixing module for preventing the form from being skewed as it is fed from the affixing module to the folding module.

* * * * *